US012285660B2

(12) United States Patent
Parsons et al.

(10) Patent No.: US 12,285,660 B2
(45) **Date of Patent: *Apr. 29, 2025**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Bradley D. Schweigert, Cave Creek, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 105 days.

This patent is subject to a terminal disclaimer.

(21) Appl. No.: 18/206,474

(22) Filed: Jun. 6, 2023

(65) Prior Publication Data

US 2023/0310955 A1 Oct. 5, 2023

Related U.S. Application Data

(63) Continuation-in-part of application No. 18/131,780, filed on Apr. 6, 2023, which is a continuation of (Continued)

(51) Int. Cl.
*A63B 53/04* (2015.01)
*A63B 53/06* (2015.01)
(Continued)

(52) U.S. Cl.
CPC ..... *A63B 53/0466* (2013.01); *A63B 53/04* (2013.01); *A63B 60/02* (2015.10); (Continued)

(58) Field of Classification Search
CPC ..... A63B 53/0466; A63B 53/04; A63B 60/02; A63B 2053/0491; A63B 53/0408; (Continued)

(56) References Cited

U.S. PATENT DOCUMENTS 1,133,129 A 3/1915 Govan
1,269,745 A 6/1918 Robertson
(Continued)

FOREIGN PATENT DOCUMENTS

JP 5690766 B2 3/2015

OTHER PUBLICATIONS

PCT/US15/42484: International Search Report and Written Opinion dated Oct. 19, 2015 (12 Pages).
(Continued)

*Primary Examiner* — Sebastiano Passaniti

(57) ABSTRACT

Embodiments of golf club heads and methods to manufacture golf club heads are generally described herein. In one example, a golf club head may include a body portion having a front portion, a rear portion, a toe portion, a heel portion, a bottom portion, a top portion. The top portion may include a heel-side top portion, a toe-side top portion, and a raised central top portion between the heel-side top portion and toe-side top portion. The top portion may include a toe-side integral rib and a heel-side integral rib. Other examples and embodiments may be described and claimed.

20 Claims, 8 Drawing Sheets

Related U.S. Application Data application No. 17/389,659, filed on Jul. 30, 2021, now Pat. No. 11,654,337, which is a continuation of application No. 16/889,524, filed on Jun. 1, 2020, now Pat. No. 11,103,755, which is a continuation of application No. 16/419,639, filed on May 22, 2019, now Pat. No. 10,695,624, which is a continuation of application No. 16/234,169, filed on Dec. 27, 2018, now Pat. No. 10,376,754, which is a continuation of application No. 16/205,583, filed on Nov. 30, 2018, now abandoned, said application No. 16/419,639 is a continuation-in-part of application No. 15/981,094, filed on May 16, 2018, now Pat. No. 10,384,102, which is a continuation of application No. 15/724,035, filed on Oct. 3, 2017, now Pat. No. 9,999,814, which is a continuation of application No. 15/440,968, filed on Feb. 23, 2017, now Pat. No. 9,795,842, said application No. 16/889,524 is a continuation-in-part of application No. 16/533,352, filed on Aug. 6, 2019, now Pat. No. 10,843,051, which is a continuation of application No. 16/030,403, filed on Jul. 9, 2018, now Pat. No. 10,413,787, application No. 18/206,474, filed on Jun. 6, 2023 is a continuation-in-part of application No. 17/400,516, filed on Aug. 12, 2021, now Pat. No. 11,779,819, which is a continuation of application No. 16/930,716, filed on Jul. 16, 2020, now Pat. No. 11,110,328, which is a continuation of application No. 16/422,661, filed on May 24, 2019, now Pat. No. 10,722,765, application No. 18/206,474, filed on Jun. 6, 2023 is a continuation-in-part of application No. 18/201,350, filed on May 24, 2023, which is a continuation of application No. 17/198,906, filed on Mar. 11, 2021, now Pat. No. 11,684,831, which is a continuation of application No. 16/813,453, filed on Mar. 9, 2020, now Pat. No. 10,967,231, application No. 18/206,474, filed on Jun. 6, 2023 is a continuation of application No. 17/198,770, filed on Mar. 11, 2021, now Pat. No. 11,707,651, which is a continuation of application No. 16/807,591, filed on Mar. 3, 2020, now Pat. No. 10,960,274.

(60) Provisional application No. 62/662,112, filed on Apr. 24, 2018, provisional application No. 62/734,176, filed on Sep. 20, 2018, provisional application No. 62/734,922, filed on Sep. 21, 2018, provisional application No. 62/740,355, filed on Oct. 2, 2018, provisional application No. 62/745,113, filed on Oct. 12, 2018, provisional application No. 62/751,456, filed on Oct. 26, 2018, provisional application No. 62/772,669, filed on Nov. 29, 2018, provisional application No. 62/621,948, filed on Jan. 25, 2018, provisional application No. 62/655,437, filed on Apr. 10, 2018, provisional application No. 62/444,671, filed on Jan. 10, 2017, provisional application No. 62/445,878, filed on Jan. 13, 2017, provisional application No. 62/530,734, filed on Jul. 10, 2017, provisional application No. 62/624,294, filed on Jan. 31, 2018, provisional application No. 62/850,292, filed on May 20, 2019, provisional application No. 62/676,860, filed on May 25, 2018, provisional application No. 62/786,371, filed on Dec. 29, 2018, provisional application No. 62/820,728, filed on Mar. 19, 2019, provisional application No. 62/816,418, filed on Mar. 11, 2019, provisional application No. 62/837,592, filed on Apr. 23, 2019, provisional application No. 62/957,757, filed on Jan. 6, 2020, provisional application No. 62/873,773, filed on Jul. 12, 2019, provisional application No. 62/897,015, filed on Sep. 6, 2019.

(51) Int. Cl.
*A63B 60/02* (2015.01)
*A63B 60/54* (2015.01)

(52) U.S. Cl.
CPC ..... *A63B 53/0408* (2020.08); *A63B 53/0412* (2020.08); *A63B 53/0433* (2020.08); *A63B 53/0475* (2013.01); *A63B 2053/0491* (2013.01); *A63B 53/06* (2013.01); *A63B 60/54* (2015.10)

(58) Field of Classification Search
CPC ..... A63B 53/0412; A63B 53/0433; A63B 53/0475; A63B 60/54; A63B 53/06
USPC ..... 473/324–350, 287–292
See application file for complete search history.

(56) References Cited

U.S. PATENT DOCUMENTS

| | | | |
|---|---|---|---|
| 1,306,029 | A | 6/1919 | Robertson |
| D55,867 | S | 7/1920 | Matters |
| 1,534,600 | A | 4/1925 | Mattern |
| 1,538,312 | A | 5/1925 | Neish |
| D138,437 | S | 8/1944 | Link |
| D138,438 | S | 8/1944 | Link |
| D138,442 | S | 8/1944 | Link |
| 3,007,369 | A | 11/1961 | Squassoni et al. |
| 3,012,038 | A | 12/1961 | Alexander et al. |
| 3,652,094 | A | 3/1972 | Glover |
| D240,748 | S | 7/1976 | Bock et al. |
| 4,085,934 | A | 4/1978 | Churchward |
| D253,778 | S | 12/1979 | Madison |
| D307,783 | S | 5/1990 | Iinuma |
| 5,106,094 | A | 4/1992 | Desbiolles et al. |
| D326,885 | S | 6/1992 | Paul |
| 5,193,810 | A | 3/1993 | Antonious |
| 5,213,329 | A | 5/1993 | Okumoto et al. |
| 5,219,408 | A | 6/1993 | Sun |
| 5,314,185 | A | 5/1994 | Gorman |
| D351,883 | S | 10/1994 | Solheim et al. |
| 5,351,958 | A | 10/1994 | Helmstetter |
| 5,467,983 | A | 11/1995 | Chen |
| 5,499,819 | A | 3/1996 | Nagamoto |
| 5,505,453 | A | 4/1996 | Mack |
| 5,518,243 | A | 5/1996 | Redman |
| 5,547,188 | A | 8/1996 | Dumontier et al. |
| D378,111 | S | 2/1997 | Parente et al. |
| 5,624,331 | A | 4/1997 | Lo et al. |
| D384,120 | S | 9/1997 | Cruz et al. |
| 5,669,824 | A | 9/1997 | Aizawa et al. |
| 5,788,584 | A | 8/1998 | Parente et al. |
| D400,625 | S | 11/1998 | Kubica et al. |
| D400,627 | S | 11/1998 | Kubica et al. |
| D405,492 | S | 2/1999 | Kubica et al. |
| 5,997,415 | A | 12/1999 | Wood |
| 6,093,116 | A | 7/2000 | Hettinger et al. |
| 6,146,287 | A | 11/2000 | Rugge et al. |
| D444,830 | S | 7/2001 | Kubica et al. |
| 6,280,349 | B1 | 8/2001 | Cook |
| 6,290,609 | B1 | 9/2001 | Takeda |
| 6,306,048 | B1 | 10/2001 | McCabe et al. |
| 6,409,612 | B1 | 6/2002 | Evans et al. |
| D478,140 | S | 8/2003 | Burrows |
| 6,638,182 | B2 | 10/2003 | Kosmatka |
| 6,773,360 | B2 | 8/2004 | Willett et al. |
| 6,855,068 | B2 | 2/2005 | Antonious |
| D508,969 | S | 8/2005 | Hasebe |
| 6,969,326 | B2 | 11/2005 | Shiell et al. |
| D513,051 | S | 12/2005 | Barez et al. |
| D514,179 | S | 1/2006 | Chen et al. |

(56) References Cited

U.S. PATENT DOCUMENTS

D514,185 S 1/2006 Barez et al.
6,991,560 B2 1/2006 Tseng
D520,586 S 5/2006 Bingman
D522,077 S 5/2006 Schweigert et al.
D522,601 S 6/2006 Schweigert et al.
D523,498 S 6/2006 Chen et al.
D526,694 S 8/2006 Schweigert et al.
7,083,530 B2 8/2006 Wahl et al.
7,121,956 B2 10/2006 Lo
D534,599 S 1/2007 Barez et al.
7,166,040 B2 1/2007 Hoffman et al.
D536,401 S 2/2007 Kawami
D536,403 S 2/2007 Kawami
7,186,190 B1 3/2007 Beach et al.
7,214,142 B2 5/2007 Meyer et al.
7,223,180 B2 5/2007 Willett et al.
7,258,625 B2 8/2007 Kawaguchi et al.
7,261,646 B2 8/2007 Shiell et al.
7,281,994 B2 10/2007 Shiell et al.
D563,498 S 3/2008 Jertson et al.
D564,054 S 3/2008 Jertson et al.
D564,055 S 3/2008 Jertson et al.
7,338,388 B2 3/2008 Schweigert et al.
7,347,794 B2 3/2008 Schweigert
D567,317 S 4/2008 Jertson et al.
D569,933 S 5/2008 Jertson et al.
D569,934 S 5/2008 Jertson et al.
D569,935 S 5/2008 Schweigert et al.
D569,936 S 5/2008 Schweigert et al.
D569,942 S 5/2008 Jertson et al.
D570,937 S 6/2008 Schweigert et al.
D570,938 S 6/2008 Jertson et al.
7,387,579 B2 6/2008 Lin et al.
7,399,238 B2 7/2008 Hocknell et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,435,190 B2 10/2008 Sugimoto
7,448,963 B2 11/2008 Beach et al.
7,448,964 B2 11/2008 Schweigert et al.
7,494,425 B2 2/2009 Shiell et al.
7,527,565 B1 5/2009 Ehlers et al.
7,530,904 B2 5/2009 Beach et al.
D594,520 S 6/2009 Schweigert et al.
D594,521 S 6/2009 Jertson et al.
D594,919 S 6/2009 Schweigert et al.
7,540,811 B2 6/2009 Beach et al.
D597,620 S 8/2009 Taylor et al.
7,568,985 B2 8/2009 Beach et al.
7,578,753 B2 8/2009 Beach et al.
D600,297 S 9/2009 Jertson et al.
7,584,531 B2 9/2009 Schweigert et al.
7,588,502 B2 9/2009 Nishino
7,591,738 B2 9/2009 Beach et al.
D603,472 S 11/2009 Schweigert et al.
7,611,424 B2 11/2009 Nagai et al.
7,621,823 B2 11/2009 Beach et al.
D605,715 S 12/2009 Barez et al.
7,632,194 B2 12/2009 Beach et al.
7,641,568 B2 1/2010 Hoffman et al.
7,713,142 B2 5/2010 Hoffman et al.
7,717,804 B2 5/2010 Beach et al.
7,717,805 B2 5/2010 Beach et al.
D618,746 S 6/2010 Jertson et al.
D618,747 S 6/2010 Schweigert et al.
D618,753 S 6/2010 Jertson et al.
D618,754 S 6/2010 Schweigert et al.
7,744,484 B1 6/2010 Chao
7,798,203 B2 9/2010 Schweigert et al.
7,846,041 B2 12/2010 Beach et al.
D635,626 S 4/2011 Nicolette
7,927,229 B2 4/2011 Jertson et al.
D638,896 S 5/2011 Schweigert et al.
7,963,861 B2 6/2011 Beach et al.
D647,585 S 10/2011 Jertson et al.
8,096,896 B2 1/2012 Schiell et al.
D661,751 S 6/2012 Nicolette et al.
D661,756 S 6/2012 Nicolette et al.
8,197,357 B1 6/2012 Rice et al.
8,202,175 B2 6/2012 Ban
8,216,087 B2 7/2012 Breier et al.
8,257,196 B1 9/2012 Abbott et al.
8,257,197 B2 9/2012 Schweigert
8,262,506 B2 9/2012 Watson et al.
8,287,402 B2 10/2012 Shiell et al.
D673,630 S 1/2013 Schweigert
D673,632 S 1/2013 Schweigert et al.
8,353,783 B2 1/2013 Soracco
8,353,787 B2 1/2013 Meyer et al.
8,371,957 B2 2/2013 Schweigert et al.
D680,179 S 4/2013 Solheim et al.
8,414,422 B2 4/2013 Peralta et al.
8,444,506 B2 5/2013 Watson et al.
8,485,919 B2 7/2013 Rice et al.
8,540,590 B2 9/2013 Tsukada et al.
D691,230 S 10/2013 Chen et al.
8,562,457 B2 10/2013 Beach et al.
8,568,248 B2 10/2013 DeShiell et al.
8,608,587 B2 12/2013 Henrikson et al.
8,628,431 B2 1/2014 Schweigert et al.
8,636,608 B2 * 1/2014 De la Cruz ..... A63B 53/0466 473/345
8,651,975 B2 2/2014 Soracco
8,663,026 B2 3/2014 Blowers et al.
8,747,253 B2 6/2014 Stites
8,777,778 B2 7/2014 Solheim et al.
8,784,232 B2 7/2014 Jertson et al.
8,790,196 B2 7/2014 Solheim et al.
8,801,543 B2 8/2014 Stites
8,808,108 B2 8/2014 Schweigert
D712,989 S 9/2014 Gillig
8,826,512 B2 9/2014 Schweigert
8,858,362 B1 10/2014 Eposky et al.
8,915,794 B2 12/2014 Stites
8,961,336 B1 2/2015 Parsons et al.
D724,164 S 3/2015 Schweigert et al.
8,979,671 B1 3/2015 Demille et al.
D729,892 S 5/2015 Nicolette et al.
D733,234 S 6/2015 Nicolette
9,199,140 B1 12/2015 Schweigert et al.
9,199,143 B1 12/2015 Parsons et al.
9,211,453 B1 12/2015 Foster et al.
D753,251 S 4/2016 Schweigert et al.
D756,471 S 5/2016 Nicolette et al.
9,352,197 B2 5/2016 Parsons et al.
D760,334 S 6/2016 Schweigert et al.
9,399,157 B2 7/2016 Greensmith et al.
9,399,158 B2 7/2016 Parsons et al.
9,427,634 B2 8/2016 Parsons et al.
9,452,325 B2 9/2016 DeShiell et al.
9,555,294 B2 1/2017 Henrikson et al.
9,630,070 B2 4/2017 Parsons et al.
9,682,295 B1 6/2017 Dawson et al.
9,717,959 B2 8/2017 Stites
9,795,842 B1 10/2017 Parsons et al.
9,821,201 B1 11/2017 Parsons et al.
9,839,821 B2 12/2017 DeShiell et al.
9,908,017 B2 3/2018 Seluga et al.
9,981,165 B2 5/2018 Goudarzi et al.
9,999,814 B2 6/2018 Parsons et al.
10,155,138 B2 12/2018 Mizutani et al.
10,376,754 B2 8/2019 Parsons et al.
10,384,102 B2 8/2019 Parsons et al.
10,413,787 B2 9/2019 Parsons et al.
10,556,161 B2 2/2020 Jertson et al.
10,695,624 B2 6/2020 Parsons et al.
10,722,765 B2 7/2020 Schweigert et al.
10,843,051 B2 11/2020 Parsons et al.
10,960,274 B2 3/2021 Parsons et al.
10,967,231 B2 4/2021 Parsons et al.
11,103,755 B2 8/2021 Parsons et al.
11,117,029 B2 9/2021 Slaughter et al.
11,198,042 B2 12/2021 Simone et al.

(56) References Cited

U.S. PATENT DOCUMENTS

| | | | | |
|---|---|---|---|---|
| 11,291,892 | B2 | 4/2022 | Jertson et al. | |
| 2003/0027662 | A1 | 2/2003 | Werner et al. | |
| 2003/0104878 | A1 | 6/2003 | Yabu | |
| 2004/0018891 | A1 | 1/2004 | Antonious | |
| 2004/0033846 | A1 | 2/2004 | Caldwell | |
| 2004/0087388 | A1 | 5/2004 | Beach et al. | |
| 2004/0116208 | A1* | 6/2004 | De Shiell | A63B 60/00 473/345 |
| 2004/0152539 | A1 | 8/2004 | Yabu | |
| 2004/0192468 | A1 | 9/2004 | Onoda et al. | |
| 2004/0209704 | A1 | 10/2004 | Mahaffey | |
| 2005/0049073 | A1 | 3/2005 | Herber | |
| 2005/0096154 | A1 | 5/2005 | Chen | |
| 2005/0101408 | A1 | 5/2005 | Sanchez et al. | |
| 2005/0192116 | A1 | 9/2005 | Imamoto | |
| 2005/0215349 | A1 | 9/2005 | Huang et al. | |
| 2005/0250596 | A1 | 11/2005 | Chuang | |
| 2006/0052181 | A1 | 3/2006 | Serrano et al. | |
| 2006/0084526 | A1 | 4/2006 | Chen | |
| 2006/0100031 | A1 | 5/2006 | Lan | |
| 2006/0105856 | A1 | 5/2006 | Lo | |
| 2006/0111200 | A1 | 5/2006 | Poynor | |
| 2006/0258482 | A1 | 11/2006 | Cackett et al. | |
| 2007/0004527 | A1 | 1/2007 | Helmstetter | |
| 2007/0238551 | A1 | 10/2007 | Yokota | |
| 2007/0293344 | A1 | 12/2007 | Davis | |
| 2008/0004133 | A1 | 1/2008 | Schweigert | |
| 2008/0015049 | A1 | 1/2008 | Imamoto | |
| 2008/0188322 | A1 | 8/2008 | Anderson et al. | |
| 2008/0261715 | A1 | 10/2008 | Carter et al. | |
| 2009/0029795 | A1 | 1/2009 | Schweigert et al. | |
| 2009/0042667 | A1* | 2/2009 | Lin | A63B 53/0466 473/345 |
| 2009/0069908 | A1 | 3/2009 | Butler, Jr. et al. | |
| 2010/0144461 | A1 | 6/2010 | Ban | |
| 2010/0167837 | A1 | 7/2010 | Ban | |
| 2010/0331102 | A1 | 12/2010 | Golden et al. | |
| 2011/0070969 | A1 | 3/2011 | Stevens et al. | |
| 2011/0143858 | A1 | 6/2011 | Peralta et al. | |
| 2011/0287859 | A1* | 11/2011 | Jertson | A63B 53/0466 473/346 |
| 2012/0083359 | A1 | 4/2012 | Stites | |
| 2012/0094782 | A1 | 4/2012 | Beach et al. | |
| 2012/0142445 | A1 | 6/2012 | Burnett et al. | |
| 2012/0190479 | A1 | 7/2012 | Rice et al. | |
| 2012/0202615 | A1 | 8/2012 | Beach et al. | |
| 2012/0220387 | A1 | 8/2012 | Beach et al. | |
| 2013/0130826 | A1 | 5/2013 | Soracco | |
| 2013/0210542 | A1 | 8/2013 | Harbert et al. | |
| 2013/0303304 | A1 | 11/2013 | Sato | |
| 2013/0318772 | A1 | 12/2013 | Wahl et al. | |
| 2013/0324281 | A1 | 12/2013 | Boyd et al. | |
| 2014/0235369 | A1 | 8/2014 | Willett et al. | |
| 2014/0274448 | A1* | 9/2014 | Willett | A63B 53/04 473/327 |
| 2015/0018123 | A1 | 1/2015 | Cole et al. | |
| 2015/0045141 | A1 | 2/2015 | Myrhum et al. | |
| 2015/0094166 | A1 | 4/2015 | Taylor et al. | |
| 2015/0126305 | A1 | 5/2015 | Stokke et al. | |
| 2015/0231454 | A1 | 8/2015 | Parsons et al. | |
| 2015/0290503 | A1 | 10/2015 | Su | |
| 2015/0360098 | A1 | 12/2015 | Parsons et al. | |
| 2016/0038799 | A1 | 2/2016 | De La et al. | |
| 2016/0059088 | A1 | 3/2016 | Parsons et al. | |
| 2016/0256753 | A1 | 9/2016 | Westrum et al. | |
| 2016/0339308 | A1 | 11/2016 | Parsons et al. | |
| 2017/0100649 | A1 | 4/2017 | Seluga et al. | |
| 2017/0312592 | A1 | 11/2017 | Parsons et al. | |

OTHER PUBLICATIONS

PCT/US16/17474: International Search Report and Written Opinion dated May 12, 2016 (9 Pages).

PCT/US17/55155: International Search Report and Written Opinion dated Jan. 25, 2018 (9 Pages).

PCT/US2015/016666: International Search Report and Written Opinion dated May 14, 2015 (8 Pages).

PCT/US2015/042282: International Search Report and Written Opinion dated Oct. 13, 2015 (12 Pages).

PCT/US2017/013513: International Search Report and Written Opinion dated Mar. 17, 2017 (18 Pages).

PCT/US2019/026099: International Search Report and Written Opinion dated May 7, 2019 (7 pages).

PCT/US2020/021869: International Search Report and Written Opinion dated May 14, 2020 (12 Pages).

Spotted: Three New PXG Drivers Appear on the USGA Conforming List (GOLFWRX). Dec. 18, 2017. Retrieved From the Internet on Jan. 16, 2019. URL:.http://www.golfwrx.com/482592/spotted-three-new-pxg-drivers-appear-on-the-usga-conforming-list/.

U.S. Appl. No. 29/512,313, Nicolette, "Golf Club Head," filed Dec. 18, 2018.

Wall. Jonathan, "Details: Phil's Prototype Mack Daddy PM—Grind Wedge," (http://www.pgatour.com/equipmentreport/2015/01/21/callaway-wedge.html), www.pgatour.com, PGA Tour, Inc., Published Jan. 21, 2015.

* cited by examiner

GOLF CLUB HEADS AND METHODS TO MANUFACTURE GOLF CLUB HEADS

CROSS-REFERENCE

This application is a continuation-in-part of application Ser. No. 18/131,780, filed Apr. 6, 2023, which is a continuation of application Ser. No. 17/389,659, filed Jul. 30, 2021, now U.S. Pat. No. 11,654,337, which is a continuation of application Ser. No. 16/889,524, filed Jun. 1, 2020, now U.S. Pat. No. 11,103,755, which is a continuation of application Ser. No. 16/419,639, filed May 22, 2019, now U.S. Pat. No. 10,695,624, which is a continuation of application Ser. No. 16/234,169, filed Dec. 27, 2018, now U.S. Pat. No. 10,376,754, which is a continuation of application Ser. No. 16/205,583, filed Nov. 30, 2018, now abandoned, which claims the benefit of U.S. Provisional Application No. 62/662,112, filed Apr. 24, 2018, U.S. Provisional Application No. 62/734,176, filed Sep. 20, 2018, U.S. Provisional Application No. 62/734,922, filed Sep. 21, 2018, U.S. Provisional Application No. 62/740,355, filed Oct. 2, 2018, U.S. Provisional Application No. 62/745,113, filed Oct. 12, 2018, U.S. Provisional Application No. 62/751,456, filed Oct. 26, 2018, U.S. Provisional Application No. 62/772,669, filed Nov. 29, 2018.

U.S. application Ser. No. 16/234,169, filed Dec. 27, 2018, now U.S. Pat. No. 10,376,754, also claims the benefit of U.S. Provisional Application No. 62/621,948, filed Jan. 25, 2018, and U.S. Provisional Application No. 62/655,437, filed Apr. 10, 2018.

U.S. application Ser. No. 16/419,639, filed May 22, 2019, now U.S. Pat. No. 10,695,624, is a continuation-in-part of application Ser. No. 15/981,094, filed May 16, 2018, now U.S. Pat. No. 10,384,102, which is a continuation of application Ser. No. 15/724,035, filed Oct. 3, 2017, now U.S. Pat. No. 9,999,814 which is a continuation of application Ser. No. 15/440,968, filed Feb. 23, 2017, now U.S. Pat. No. 9,795,842, which claims the benefit of U.S. Provisional Application No. 62/444,671, filed Jan. 10, 2017, and U.S. Provisional Application No. 62/445,878, filed Jan. 13, 2017.

U.S. application Ser. No. 16/889,524 is a continuation-in-part of application Ser. No. 16/533,352, filed Aug. 6, 2019, now U.S. Pat. No. 10,843,051, which is a continuation of application Ser. No. 16/030,403, filed Jul. 9, 2018, now U.S. Pat. No. 10,413,787, which claims the benefit of U.S. Provisional Application No. 62/530,734, filed Jul. 10, 2017, and U.S. Provisional Application No. 62/624,294, filed Jan. 31, 2018."

This application is a continuation-in-part of application Ser. No. 17/400,516, filed Aug. 12, 2021, which is a continuation of application Ser. No. 16/930,716, filed Jul. 16, 2020, now U.S. Pat. No. 11,110,328, which is a continuation of application Ser. No. 16/422,661, filed May 24, 2019, now U.S. Pat. No. 10,722,765, which claims the benefit of U.S. Provisional Application No. 62/850,292, filed May 20, 2019, U.S. Provisional Application No. 62/676,860, filed May 25, 2018, U.S. Provisional Application No. 62,786,371, filed Dec. 29, 2018, U.S. Provisional Application No. 62/820,728, filed Mar. 19, 2019, U.S. Provisional Application No. 62/816,418, filed Mar. 11, 2019, and U.S. Provisional Application No. 62/837,592, filed Apr. 23, 2019.

This application is a continuation-in-part of application Ser. No. 18/201,350, filed May 24, 2023, which is a continuation of application Ser. No. 17/198,906, filed Mar. 11, 2021, which is a continuation of application Ser. No. 16/813,453, filed Mar. 9, 2020, now U.S. Pat. No. 10,967,231, which claims the benefit of U.S. Provisional Application No. 62/816,418, filed Mar. 11, 2019, U.S. Provisional Application No. 62/957,757, filed Jan. 6, 2020, U.S. Provisional Application No. 62/837,592, filed Apr. 23, 2019, U.S. Provisional Application No. 62/873,773, filed Jul. 12, 2019, and U.S. Provisional Application No. 62/897,015, filed Sep. 6, 2019.

This application is a continuation of application Ser. No. 17/198,770, filed Mar. 11, 2021, which is a continuation of application Ser. No. 16/807,591, filed Mar. 3, 2020, now U.S. Pat. No. 10,960,274, which claims the benefit of U.S. Provisional Application No. 62/837,592, filed Apr. 23, 2019, U.S. Provisional Application No. 62/873,773, filed Jul. 12, 2019, U.S. Provisional Application No. 62/897,015, filed Sep. 6, 2019, U.S. Provisional Application No. 62/820,728, filed Mar. 19, 2019, U.S. Provisional Application No. 62/816,418, filed Mar. 11, 2019, and U.S. Provisional Application No. 62/957,757, filed Jan. 6, 2020.

The disclosures of all the above referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
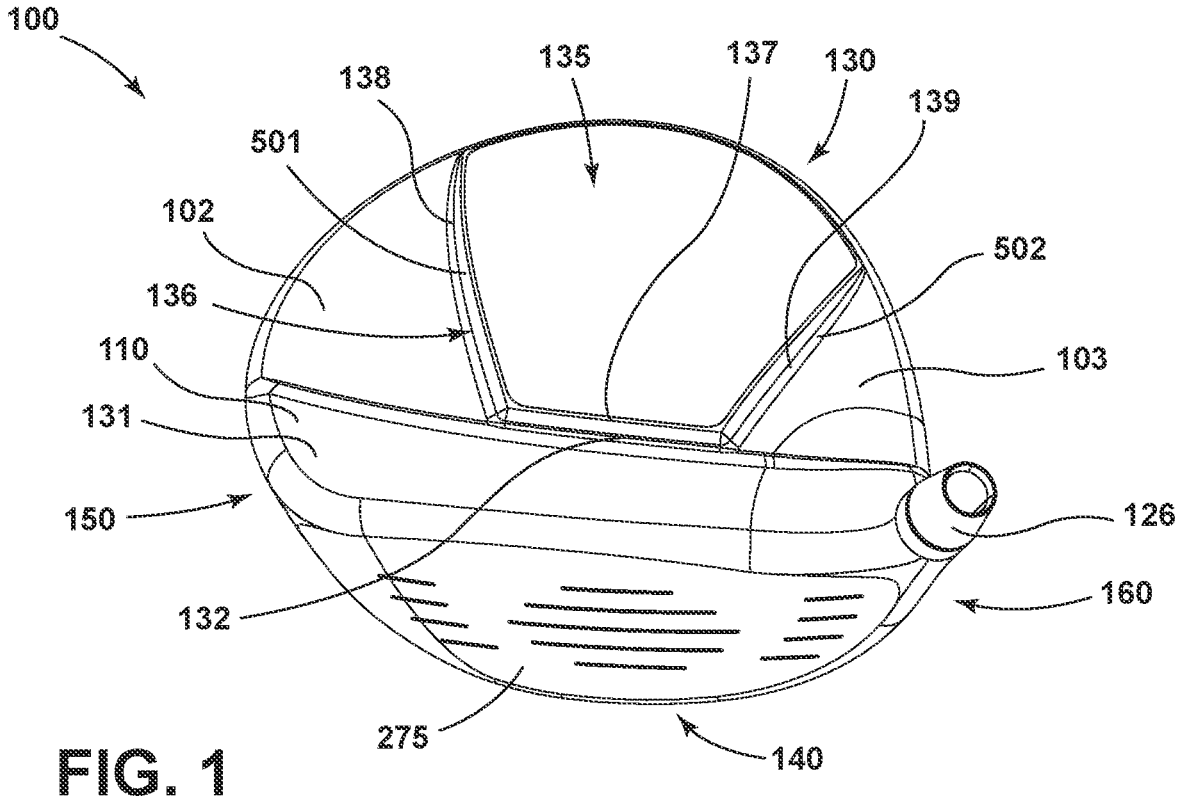
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard. In the example of FIGS. 1-13, a golf club head 100 may include a body portion 110 with a top portion 130, a crown portion 135, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. Alternatively, the golf club head 100 may not include the skirt portion 190. The front portion 170 may include a face portion 275 to engage a golf ball. The face portion 275 may be integral to the body portion 110 or may be a separate face portion that is coupled (e.g., welded) to the front portion 170 to enclose an opening in the front portion 170. The body portion 110 may also include a hosel portion configured to receive a shaft portion (not shown). The hosel portion may be similar in many respects to any of the hosel portions described herein. The hosel portion may include an interchangeable hosel sleeve 126 and a fastener 127. Alternatively, the body portion 110 may include a bore instead of the hosel portion. The body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material. The apparatus, methods, and articles of manufacture described herein are not limited in this regard.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Figure 8:
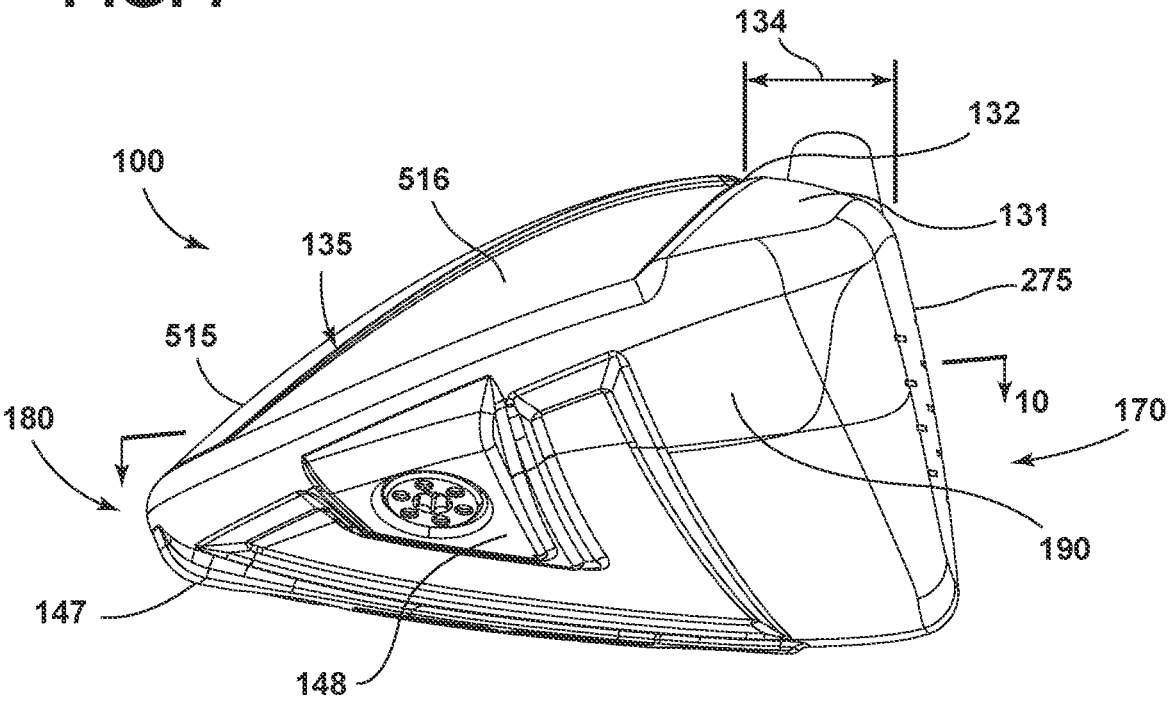
FIG. 8 is a toe side view of the golf club head of FIG. 1.

The top portion 130 may include a forward portion 131 extending a distance 134 between the front portion 170 and the crown portion 135, as shown in FIG. 8. In one example, the forward portion 131 may extend a distance 134 of at least 8 mm in a front-to-rear direction, resulting in the crown portion 135 being positioned at least 8 mm rearward of the face portion 275. In another example, the forward portion 131 may extend a distance 134 of at least 12 mm in a front-to-rear direction. In another example, the forward portion 131 may extend a distance 134 of at least 16 mm in a front-to-rear direction. In yet another example, the forward portion 131 may extend a distance 134 of at least 20 mm in a front-to-rear direction. In still another example, the forward portion 131 may extend a distance 134 of between and including 12 mm and 20 mm in a front-to-rear direction. While the above examples may describe particular distances, the apparatus, methods, and articles of manufacture described herein may include a forward portion extending a distance less than 12 mm in a front-to-rear direction. The apparatus, methods, and articles of manufacture described herein are not limited in this regard.

The forward portion 131 may enhance structural integrity of the golf club head 100 and resist rearward deflection of the front portion 170 during impact with a golf ball. The forward portion 131 may transfer an impact force to the crown portion 135 during an impact with a golf ball. The forward portion 131 may distribute an impact force along a surface of the crown portion that abuts a junction 132 formed between the crown portion 135 and the forward portion 131 of the top portion 130. The forward portion 131 may be an integral portion of the body portion 110. In examples where the body portion 110 is formed through a metal (e.g. titanium) casting process, the forward portion 131 may be formed as an integral portion of the body portion during the casting process. The apparatus, methods, and articles of manufacture described herein are not limited in this regard.

The crown portion 135 may be a separate piece that may be attached to the top portion 130. The crown portion 135 may enclose an opening 1201 in the top portion 130. The crown portion 135 may include a heel-side perimeter 1131, a front perimeter 1132, a rear perimeter 1151, and a toe-side perimeter 1133. The apparatus, methods, and articles of manufacture described herein are not limited in this regard.

Figure 12:
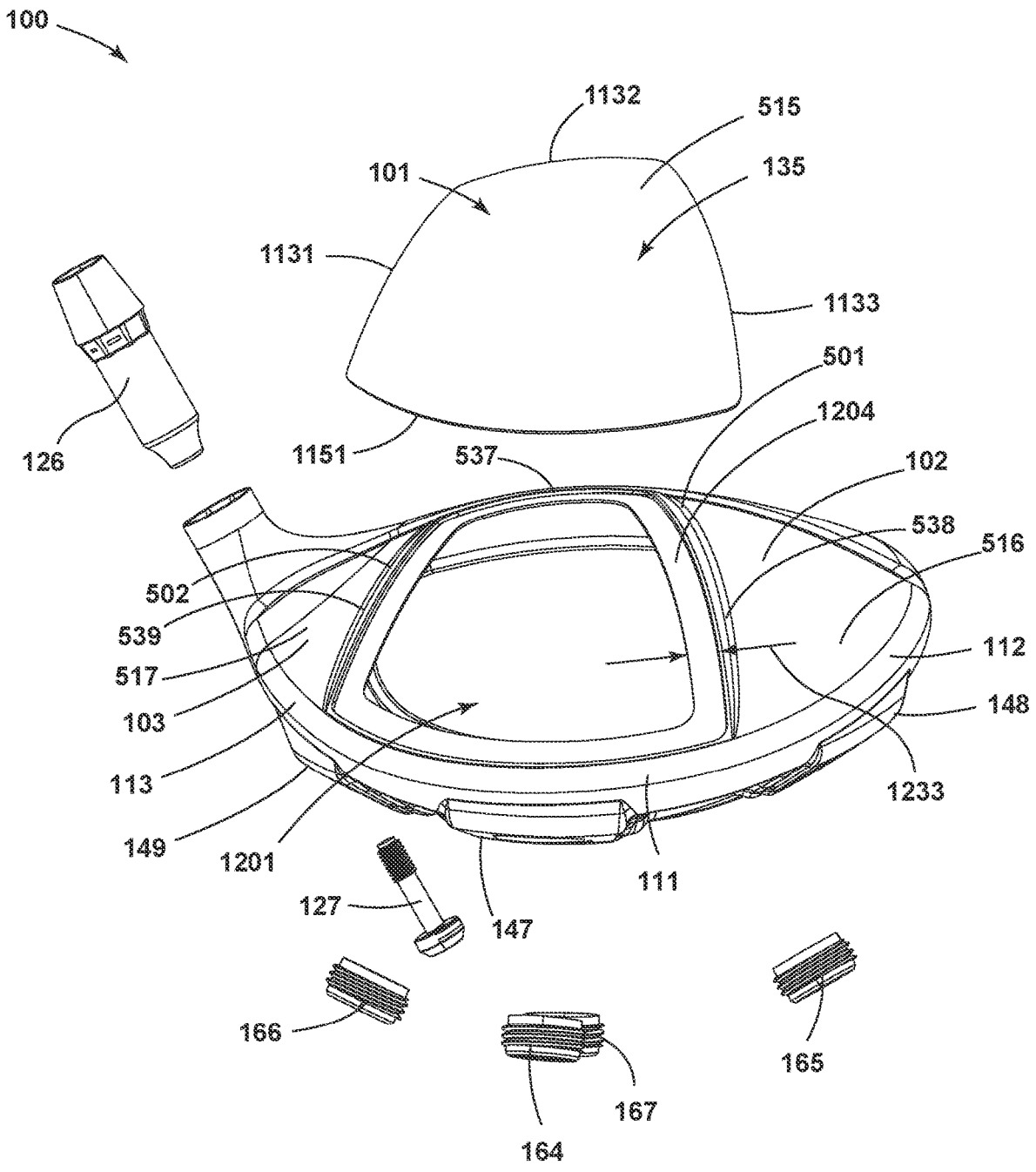
FIG. 12 is an exploded rear view of the golf club head of FIG. 1.
Figure 13:
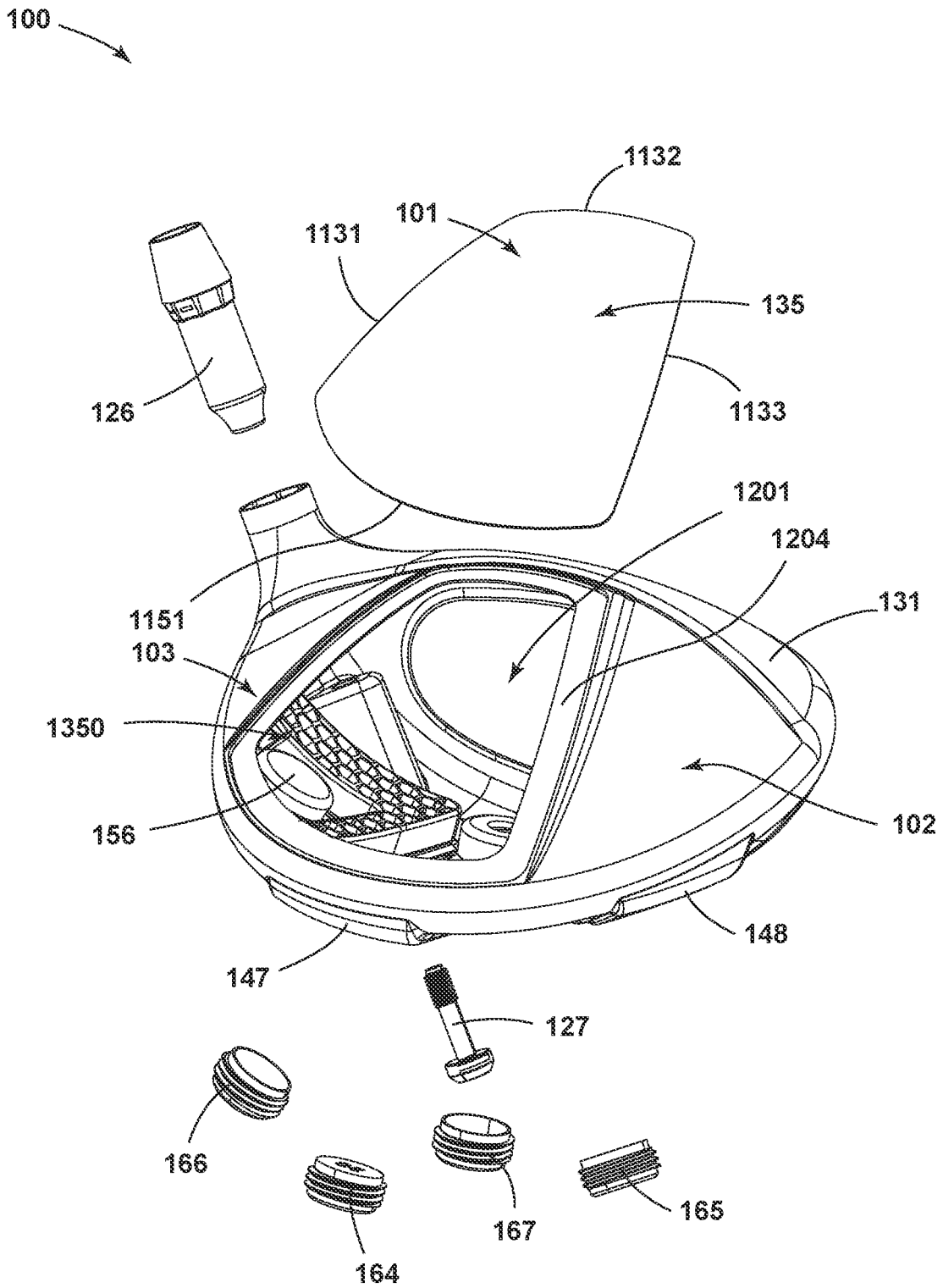
FIG. 13 is an exploded rear perspective view of the golf club head of FIG. 1.

As illustrated in FIGS. 12 and 13, for example, the top portion 130 of the golf club head 100 may include an opening 1201 prior to installation of the crown portion 135. The crown portion 135 may be constructed from one or more materials, and those materials may be the same or different from the material of the body portion 110. In one example, the crown portion 135 may be at least partially constructed from a composite material such as a fiber-based composite material. The crown portion 135 may be attached to a shoulder portion 1204 of the top portion 130. The shoulder portion 1204 may extend along an entire perimeter of the opening 1201 in the top portion 130 or a portion of the opening in the top portion 130. The shoulder portion 1204 may support the crown portion 135. The shoulder portion 1204 may provide a surface suitable for joining (e.g. adhering) the crown portion 135 to the top portion. In one example, the shoulder portion 1204 may extend a distance 1233 of at least 2 mm inward toward the opening 1201 in the top portion 130. In another example, the shoulder portion 1204 may extend a distance 1233 of at least 6 mm. In yet another example, the shoulder portion 1204 may extend a distance 1233 of at least 8 mm. In still another example, the shoulder portion 1204 may extend a distance 1233 of between and including 2 mm and 8 mm. While the above examples may describe particular distances, the apparatus, methods, and articles of manufacture described herein may include a shoulder portion 1204 that extends a distance 1233 less than 2 mm inward toward the opening in the top portion 130. The shoulder portion 1204 may be a continuous portion encircling the opening 1201 in the top portion 130. Alternately, the shoulder portion 1204 may include one or more discrete shoulder portions arranged to support the crown portion 135. In another example, the shoulder portion 1204 may include a plurality of tabs arranged to support the crown portion 135. In still another example, the shoulder portion 1204 may be omitted, and the crown portion 135 may be adhered to an outer surface of the top portion 130 or to an inner surface of the top portion 130. In yet another example, the shoulder portion 1204 may be omitted, and the crown portion 135 may include a protrusion extending from a bottom surface of the crown portion 135 that provides an interference fit with a perimeter edge of the opening 1201 in the top portion 130. The apparatus, methods, and articles of manufacture described herein are not limited in this regard.

In one example, the crown portion 135 may have a thickness of less than 1.0 mm. In another example, the crown portion 135 may have a thickness of less than 0.75 mm. In yet another example, the crown portion 135 may have a thickness of less than or equal to 0.65 mm. The crown portion 135 may be made of a composite material. While the above examples may describe particular thicknesses, the apparatus, methods, and articles of manufacture described herein may have a thickness greater than or equal to 1.0 mm. The apparatus, methods, and articles of manufacture described herein are not limited in this regard.

In one example, the crown portion 135 may form at least 45% of an exterior surface area of the top portion 130. In another example, the crown portion 135 may form at least 55% of an exterior surface area of the top portion 130. In yet another example, the crown portion 135 may form at least 65% of an exterior surface area of the top portion 130. While the above examples may describe particular percentages, the crown portion 135 may form less than 45% of the exterior surface area of the top portion 130. The apparatus, methods, and articles of manufacture described herein are not limited in this regard.

A top stiffening portion 136 may enhance stiffness of the top portion 130. The top stiffening portion 136 may compensate for the presence of one or more relatively less stiff, thin, or lightweight regions elsewhere in the top portion 130 or crown portion 135. The top stiffening portion 136 may enhance overall stiffness of the golf club head 100. The top stiffening portion 136 may limit rearward deflection of the face portion 275 and/or forward portion 131 toward the rear portion 180 in response to the face portion 275 impacting a golf ball. The top stiffening portion 136 may resist physical compression of the crown portion 135 in a front-to-rear direction in response to the face portion 275 impacting a golf ball, which may reduce risk of cracking or delaminating of the crown portion 135 in examples where the crown portion 135 is constructed of two or more layers of composite material. The top stiffening portion 136 may be a raised portion of the top portion 130. The top stiffening portion 136 may be part of a contoured portion of the top portion 130. The top stiffening portion 136 may serve as a visual alignment aid for a golfer aligning a golf shot. The top stiffening portion 136 may improve acoustic response of the golf club head 100 in response to the face portion 275 impacting a golf ball. The top stiffening portion 136 may have a thickness greater than another region of the top portion 130 or the crown portion 135. The top stiffening portion 136 may have a thickness greater than an average thickness of the crown portion 135. The top stiffening portion 136 may be integral to the top portion 130. The top stiffening portion 136 may be one or more separate portions adhered or joined to the top portion 130 to provide structural reinforcement. The apparatus, methods, and articles of manufacture described herein are not limited in this regard.

As mentioned above, the top portion 130 may include one or more top stiffening portions. In one example, the top stiffening portion 136 may include a first top stiffening portion 137, a second top stiffening portion 138, and a third top stiffening portion 139, as shown in FIG. 1. The first top stiffening portion 137 may be located adjacent to the forward portion 131 of the top portion 130. The first top stiffening portion 137 may have a thickness greater than an average thickness of the crown portion 135. In one example, the first top stiffening portion 137 may have a thickness of greater than 2 mm. In another example, the first top stiffening portion 137 may have a thickness of greater than or equal to 2.1 mm. In another example, the first top stiffening portion 137 may have a thickness of greater than or equal to 2.2 mm. In still another example, the first top stiffening portion 137 may have a thickness of greater than or equal to 2.4 mm. While the above examples may describe particular thickness, the apparatus, methods, and articles of manufacture described herein may include the first top stiffening portion 137 with a thickness of less than or equal to 2 mm. In one example, the first top stiffening portion 137 may have a length of at least 1.25 cm in a heel-to-toe direction. In another example, the first top stiffening portion 137 may have a length of at least 2 cm in a heel-to-toe direction. In yet another example, the first top stiffening portion 137 may have a length of at least 3 cm in a heel-to-toe direction. In still yet another example, the first top stiffening portion 137 may have a length of at least 4 cm in a heel-to-toe direction. In another example, the first top stiffening portion 137 may have a length of between and including 4 and 4.5 cm in a heel-to-toe direction. While the above examples may describe particular lengths, the apparatus, methods, and articles of manufacture describe herein may include the first top stiffening portion 137 having a length of less than 3 cm. The first top stiffening portion 137 may reduce aerodynamic drag of the golf club head 100. The apparatus, methods, and articles of manufacture described herein are not limited in this regard.

The second top stiffening portion 138 may extend from the first top stiffening portion 137 toward the rear portion 180. The second top stiffening portion 138 may extend from the first top stiffening portion 137 toward the rear portion 180 and toward the toe portion 150. The second top stiffening portion 138 may extend from a toe-side end of the first top stiffening portion 137 to a rear perimeter of the crown portion 135. The second top stiffening portion 138 may extend from the first top stiffening portion 137 toward a weight port region on the bottom portion 140. The second top stiffening portion 138 may extend from the first top stiffening portion 137 toward a weight port region on the bottom portion 140, where the weight port region is closer to the toe portion 150 than other weight port regions on the bottom portion. The second top stiffening portion 138 may taper in width in a front-to-rear direction. The apparatus, methods, and articles of manufacture described herein are not limited in this regard.

The second top stiffening portion 138 may serve as a support structure between the forward portion 131 and the rear portion 180. The second top stiffening portion 138 may oppose rearward deflection of the forward portion 131 in response to the face portion 275 impacting a golf ball. The second top stiffening portion 138 may have a thickness greater than an average thickness of the crown portion 135. The second top stiffening portion 138 may have a thickness of greater than 2 mm. The second top stiffening portion 138 may have a thickness of greater than or equal to 2.1 mm. The second top stiffening portion 138 may have a thickness of greater than or equal to 2.2 mm. While the above examples may describe particular thicknesses, the apparatus, methods, and articles of manufacture described herein may include the second top stiffening portion 138 with a thickness of less than or equal to 2 mm. In one example, the second top stiffening portion 138 may have a length of at least 2 cm. In another example, the second top stiffening portion 138 may have a length of at least 4 cm. While the above examples may describe particular lengths, the apparatus, methods, and articles of manufacture describe herein may include a second top stiffening portion 138 having a length less than 2 cm. The second top stiffening portion 138 may reduce aerodynamic drag of the golf club head. The apparatus, methods, and articles of manufacture described herein are not limited in this regard.

The third top stiffening portion 139 may extend from the first top stiffening portion 137 toward the rear portion 180. The third top stiffening portion 139 may extend from the first top stiffening portion 137 toward the rear portion 180 and toward the heel portion 160. The third top stiffening portion 139 may extend from a heel-side end of the first top stiffening portion 137 to a rear perimeter of the crown portion 135. The third top stiffening portion 139 may extend from the first top stiffening portion 137 toward a weight port region on the bottom portion 140. The third top stiffening portion 139 may extend from the first top stiffening portion 137 toward a weight port region on the bottom portion 140, where the weight port region is closer to the heel portion 160 than other weight port regions on the bottom portion. The third top stiffening portion 139 may taper in width in a front-to-rear direction. The apparatus, methods, and articles of manufacture described herein are not limited in this regard.

The third top stiffening portion 139 may serve as a support structure between the forward portion 131 and the rear portion 180. The third top stiffening portion 139 may oppose rearward deflection of the forward portion 131 in response to the face portion 275 impacting a golf ball. The third top stiffening portion 139 may have a thickness greater than an average thickness of the crown portion 135. The third top stiffening portion 139 may have a thickness of greater than 2 mm. The third top stiffening portion 139 may have a thickness of greater than or equal to 2.1 mm. The third top stiffening portion 139 may have a thickness of greater than or equal to 2.2 mm. While the above examples may describe particular thicknesses, the apparatus, methods, and articles of manufacture described herein may include the third top stiffening portion 139 with a thickness of less than or equal to 2 mm. The third top stiffening portion 139 may have a length of at least 2 cm. The third top stiffening portion 139 may have a length of at least 4 cm. The third top stiffening portion 139 may reduce aerodynamic drag of the golf club head. While the above example may describe a particular number of top stiffening portions, the apparatus, methods, and articles of manufacture described herein may include more or fewer top stiffening portions. The apparatus, methods, and articles of manufacture described herein are not limited in this regard.

Figure 7:
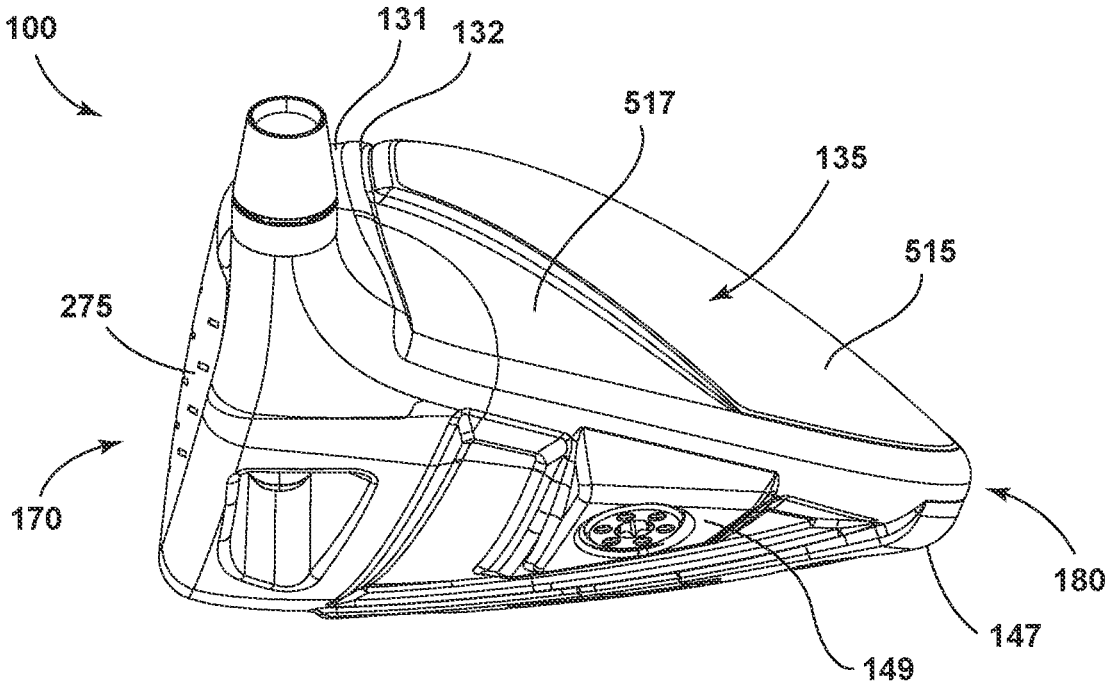
FIG. 7 is a heel side view of the golf club head of FIG. 1.

The top portion 130 may include a central top portion 101, a toe-side top portion 102, and a heel-side top portion 103. The central top portion 101 may be a raised central top portion 101. The raised central top portion 101 may be located between the heel-side top portion 103 and the toe-side top portion 102. The raised central top portion 101 may have a maximum height greater than a maximum height of the toe-side top portion 102, as shown in FIG. 8. The raised central top portion 101 may have a maximum height greater than a maximum height of the heel-side top portion 103, as shown in FIG. 7. The raised central top portion 101 may serve as a visual alignment aid. The raised central top portion 101 may improve aerodynamic performance of the golf club head 100. The raised central top portion 101 may stiffen the top portion 130 and reduce deflection (e.g. bulging) of the top portion 130 in response to the face portion 275 impacting a golf ball. Reducing bulging of the top portion 130 may be desirable to reduce shear stress on a joint (e.g. an adhesive bond) between the crown portion 135 and the shoulder portion 1204 of the opening 1201 in the top portion 130. The apparatus, methods, and articles of manufacture described herein are not limited in this regard.

The central top portion 101 may include a thin portion. The toe-side top portion 102 may include a thin portion. The heel-side top portion 103 may include a thin portion. Thin portions may be desirable to reduce overall mass of the top portion 130, which may lower the CG of the golf club head 100. The apparatus, methods, and articles of manufacture described herein are not limited in this regard.

The top portion 130 may include a plurality of contoured surfaces. The plurality of contoured surfaces may generate turbulent flow across the top portion 130 of the golf club head 100 during a golf swing. The plurality of contoured surfaces may reduce aerodynamic drag of the golf club head 100. The plurality of contoured surfaces may enhance rigidity of the golf club head 100. The plurality of contoured surfaces may enhance structural integrity of the golf club head 100. The apparatus, methods, and articles of manufacture described herein are not limited in this regard An outer surface 515 of the central top portion 101 may be elevated above an outer surface 516 of the toe-side top portion 102. The outer surface 515 area of the central top portion 101 may be elevated above an outer surface 517 of the heel-side top portion 103. The apparatus, methods, and articles of manufacture described herein are not limited in this regard. The apparatus, methods, and articles of manufacture described herein are not limited in this regard The top portion 130 may include a first contoured transition region 501 located between the central top portion 101 and the toe-side top portion 102. The crown portion 135 may include a second contoured transition region 502 located between the central top portion 101 and the heel-side top portion 103. The location of the first contoured transition region 501 may coincide with the location of the second top stiffening portion 138. The location of the second contoured transition region 502 may coincide with the location of the third top stiffening portion 139. Together, the central top portion 101, toe-side top portion 102, heel-side top portion 103, first contoured transition region 501, and second contoured transition region 502 may form a multi-level top portion 130. Together, the central top portion 101, toe-side top portion 102, heel-side top portion 103, first contoured transition region 501, and second contoured transition region 502 may form a multi-thickness top portion 130. The apparatus, methods, and articles of manufacture described herein are not limited in this regard.

Figure 5:
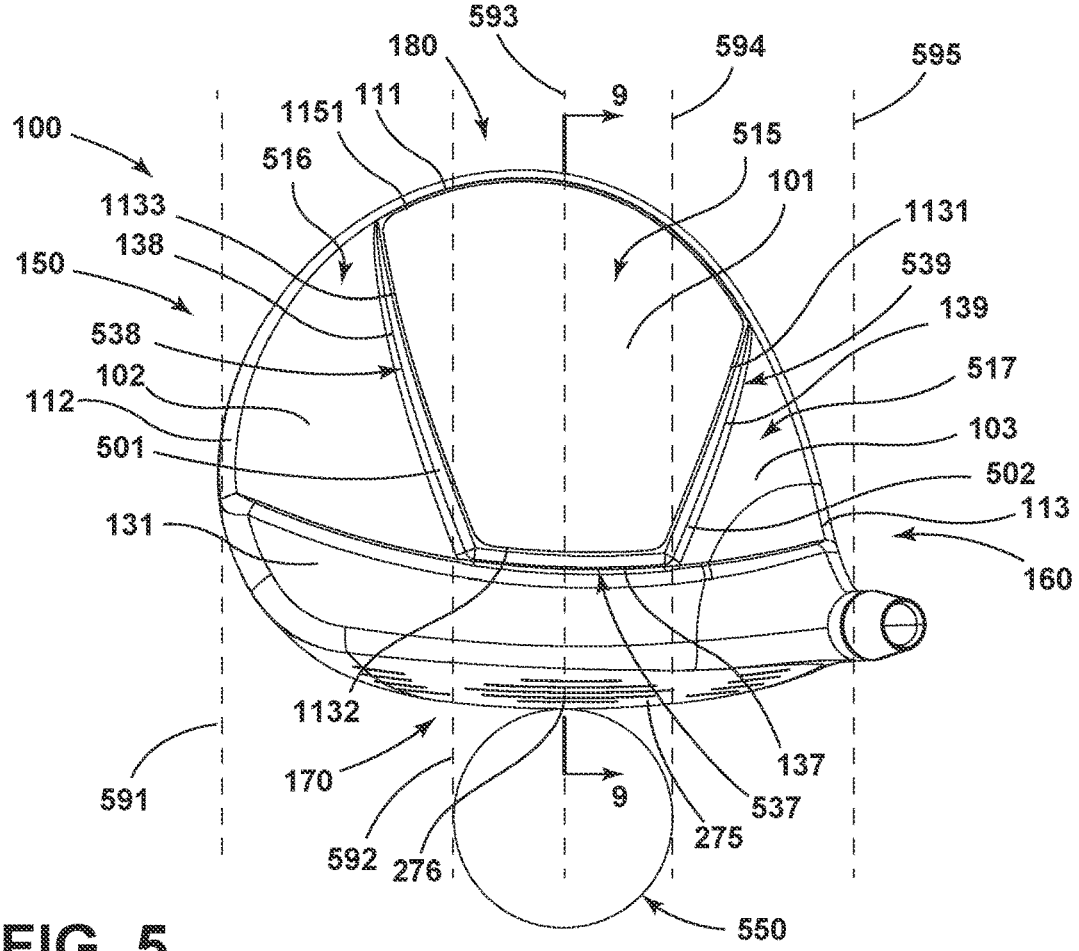
FIG. 5 is a top view of the golf club head of FIG. 1.
Figure 9:
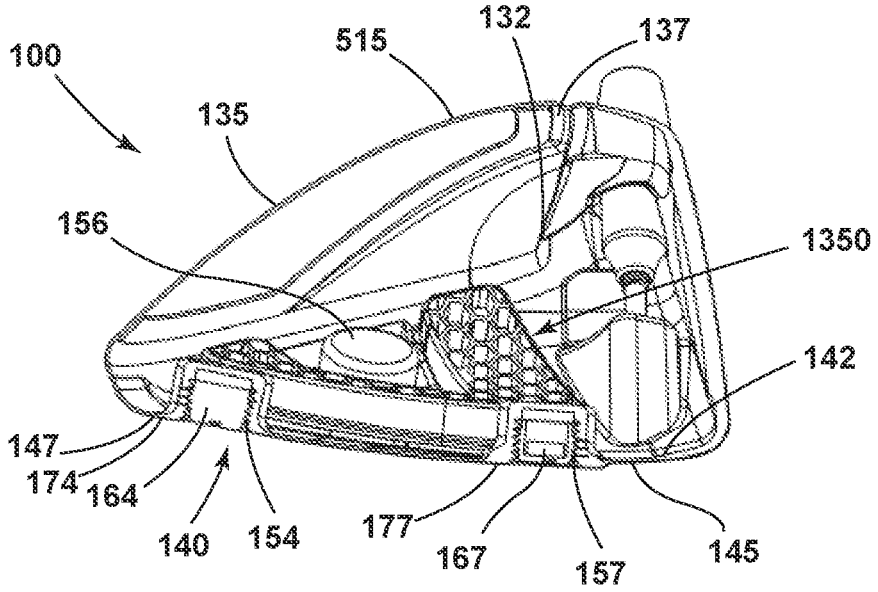
FIG. 9 is a cross-sectional view of the golf club head of FIG. 1 taken along section 9-9 of FIG. 5.

FIG. 9 depicts a cross-sectional toe side view of the example golf club head of FIG. 1 taken at section line 9-9 of FIG. 5. The outer surface 515 of the central top portion 101 may be elevated above an outer surface 517 of the heel-side top portion 103. In one example, the outer surface 515 of the central top portion 101 may be elevated above an outer surface 517 of the heel-side top portion 103 by a height of greater than or equal to 0.5 mm. In another example, the outer surface 515 of the central top portion 101 may be elevated above an outer surface 517 of the heel-side top portion 103 by a height of greater than or equal to 1.0 mm. In yet another example, the outer surface 515 of the central top portion 101 may be elevated above an outer surface 517 of the heel-side top portion 103 by a height of greater than or equal to 2.0 mm. The apparatus, methods, and articles of manufacture described herein are not limited in this regard.

The outer surface 515 of the central top portion 101 may be elevated above an outer surface 516 of the toe-side top portion 102. In one example, the outer surface 515 of the central top portion 101 may be elevated above an outer surface 516 of the toe-side top portion 102 by a height of greater than or equal to 0.5 mm. In another example, the outer surface 515 of the central top portion 101 may be elevated above an outer surface 516 of the toe-side top portion 102 by a height of greater than or equal to 1.0 mm. In yet another example, the outer surface 515 of the central top portion 101 may be elevated above an outer surface 516 of the toe-side top portion 102 by a height of greater than or equal to 2.0 mm. While the above examples may describe particular heights, the apparatus, methods, and articles of manufacture described herein may include outer surfaces with a difference in height of less than 0.5 mm. The apparatus, methods, and articles of manufacture described herein are not limited in this regard.

As shown in FIG. 7, the outer surface 517 of the heel-side top portion 103 may be recessed below the forward portion 131 proximate to the junction 132. Likewise, as shown in FIG. 8, the outer surface 516 of the toe-side top portion 102 may be recessed below the forward portion 131 proximate the junction 132. In one example, the outer surface 517 of the heel-side top portion 103 may be recessed below the forward portion 131 proximate to the junction 132 by a distance of greater than or equal to 0.5 mm. In another example, the outer surface 517 of the heel-side top portion 103 may be recessed below the forward portion 131 proximate to the junction 132 by a distance of greater than or equal to 1.0 mm. In yet another example, the outer surface 516 of the toe-side top portion 102 may be recessed below the forward portion 131 proximate the junction 132 by a distance of greater than or equal to 0.5 mm. The outer surface 516 of the toe-side top portion 102 may be recessed below the forward portion 131 proximate the junction 132 by a distance of greater than or equal to 1.0 mm. While the above examples may describe particular distances, the apparatus, methods, and articles of manufacture described herein may include outer surfaces recessed by distances of less than 0.5 mm. The apparatus, methods, and articles of manufacture described herein are not limited in this regard.

The central top portion 101 may be bounded by the first contoured transition region 501, the second contoured transition region 502, a rear perimeter 1151, and a front perimeter 1132, as shown in FIGS. 5 and 12. The central top portion 101 may be bounded by the first contoured transition region 501, the second contoured transition region 502, a rear body perimeter 111, and a front perimeter 1132, as shown in FIG. 5. The central top portion 101 may be bounded by the first top stiffening portion 137, the second top stiffening portion 138, the third top stiffening portion 139, and the rear perimeter 1151, as shown in FIG. 5. The apparatus, methods, and articles of manufacture described herein are not limited in this regard.

A front region of the central top portion 101 may have a symmetrical shape relative to a central vertical plane 593 that intersects the geometric center (e.g., at or proximate to a "sweet spot" of the golf club head 100) on the face portion 275 and is normal to a front vertical plane. A front portion of the central top portion 101 may have a nonsymmetrical shape relative to the central vertical plane 593 that intersects the geometric center on the face portion 275 and is normal to the front vertical plane. The apparatus, methods, and articles of manufacture described herein are not limited in this regard.

In one example, the second top stiffening portion 138 and third top stiffening portion 139 may diverge in a front-to-rear direction, as shown in FIG. 5. The central top portion 101 may have an irregular polygon-like shape (e.g., a quadrilateral-like shape). The distance between the second and third top stiffening portions 138 and 139 at or proximate to the front portion 170 may be less than the distance between the second and third top stiffening portions 138 and 139 at or proximate to the rear portion 180. In another example, the second top stiffening portion 138 and third top stiffening portion 139 may converge in a front-to-rear direction. A distance between the second and third top stiffening portions 138 and 139 at or proximate to the front portion 170 may be greater than a distance between the second and third top stiffening portions 138 and 139 at or proximate to the rear portion 180. In yet another example, the second top stiffening portion 138 and third top stiffening portion 139 may converge and then diverge in a front-to-rear direction. In another example, the second top stiffening portion 138 and third top stiffening portion 139 may diverge and then converge in a front-to-rear direction. In still another example, the second top stiffening portion 138 and third top stiffening portion 139 may be substantially parallel in a front-to-rear direction. The distance between the second stiffening portion 138 and third top stiffening portion 139 at or proximate to the front portion 170 may be equal or substantially the same as the distance between the second and third top stiffening portions 138 and 139 at or proximate to the rear portion 180. The apparatus, methods, and articles of manufacture described herein are not limited in this regard.

In one example, as shown in FIG. 1, the central top portion 101 may be raised relative to the toe-side top portion 102 and the heel-side top portion 103, resulting in a raised central top portion 101. Variations in relative heights of the central top portion 101, toe-side top portion 102, and heel-side top portion 103 may improve aerodynamic performance by reducing a drag coefficient associated with the golf club head 100. Variations in relative heights of the central top portion 101, toe-side top portion 102, and heel-side top portion 103 may provide a visual alignment aid. Variations in relative heights of the central top portion 101, toe-side top portion 102, and heel-side top portion 103, together with contoured transition regions (501, 502) with integral ribs, may enhance structural integrity of the top portion 130. In another example, the central top portion 101 may be depressed relative to the toe-side top portion 102 and the heel-side top portion 103. The apparatus, methods, and articles of manufacture described herein are not limited in this regard.

The total surface area of the top portion 130 may include surface areas of the central top portion 101, toe-side top portion 102, heel-side top portion 103, first contoured transition region 501, second contoured transition region 502, and the forward portion 131. In one example, the surface area of the central top portion 101 may be less than or equal to 40% of the total surface area of the top portion 130. In another example, the surface area of the central top portion 101 may be at least 10% of the total surface area of the top portion 130. In another example, the surface area of the central top portion 101 may be at least 20% of the total surface area of the top portion 130. In yet another example, the surface area of the central top portion 101 may be at least 30% of the total surface area of the top portion 130. In still yet another example, the surface area of the central top portion 101 may be at least 40% of the total surface area of the top portion 130. In still yet another example, the surface area of the central top portion 101 may be at least 50% of the surface area of the top portion 130. In another example, the surface area of the central top portion 101 may be at least 60% of the total surface area of the top portion 130. In still yet another example, the surface area of the central top portion 101 may be at least 70% of the total surface area of the top portion 130. In still yet another example, the surface area of the central top portion 101 may be at least 80% of the total surface area of the top portion 130. In still yet another example, the surface area of the central top portion 101 may be at least 90% of the total surface area of the top portion 130. The apparatus, methods, and articles of manufacture described herein are not limited in this regard.

The toe-side top portion 102 may be bounded by the first contoured transition region 501, a toe-side body perimeter 112, and the forward portion 131. In one example, the surface area of the toe-side top portion 102 may be at least 5% of the total surface area of the top portion 130. In another example, the surface area of the toe-side top portion 102 may be at least 10% of the total surface area of the crown portion 135. In yet another example, the surface area of the toe-side top portion 102 may be at least 15% of the total surface area of the top portion 130. In still yet another example, the surface area of the toe-side top portion 102 may be at least 20% of the surface area of the top portion 130. In still yet another example, the surface area of the toe-side top portion 102 may be at least 25% of the total surface area of the top portion 130. In still yet another example, the surface area of the toe-side top portion 102 may be at least 30% of the total surface area of the top portion 130. In still yet another example, the surface area of the toe-side top portion 102 may be at least 35% of the total surface area of the top portion 130. In still yet another example, the surface area of the toe-side top portion 102 may be at least 40% of the total surface area of the top portion 130. The apparatus, methods, and articles of manufacture described herein are not limited in this regard.

The heel-side top portion 103 may be bounded by the second contoured transition region 502, a heel-side body perimeter 113, and the forward portion 131. In one example, the surface area of the heel-side top portion 103 may be at least 5% of the total surface area of the top portion 130. In another example, the surface area of the heel-side top portion 103 may be at least 10% of the total surface area of the top portion 130. In yet another example, the surface area of the heel-side top portion 103 may be at least 15% of the total surface area of the top portion 130. In still yet another example, the surface area of the heel-side top portion 103 may be at least 20% of the total surface area of the top portion 130. In still yet another example, the surface area of the heel-side top portion 103 may be at least 25% of the total surface area of the top portion 130. In still yet another example, the surface area of the heel-side top portion 103 may be at least 30% of the total surface area of the top portion 130. The apparatus, methods, and articles of manufacture described herein are not limited in this regard.

In one example, the outer surface 515 area of the central top portion 101 may be greater than or equal to 40% of a total outer surface area of the top portion 130, the outer surface 516 area of the toe-side top portion 102 may be less than or equal to 30% of the total outer surface area of the top portion 130, and the outer surface 517 area of the heel-side top portion 103 be less than or equal to 15% of the total outer surface area of the top portion 130. In another example, the outer surface area 515 of the central top portion 101 may be greater than or equal to 50% of a total outer surface area of the top portion 130, the outer surface area of the toe-side top portion 102 may be greater than or equal to 15% of the total outer surface area of the top portion 130, and the outer surface area of the heel-side top portion 103 be greater than or equal to 5% of the total outer surface area of the top portion 130. In another example, the outer surface area 515 of the central top portion 101 may be greater than or equal to 30% of a total outer surface area of the top portion 130, the outer surface area of the toe-side top portion 102 may be greater than or equal to 10% of the total outer surface area of the top portion 130, and the outer surface area of the heel-side top portion 103 be greater than or equal to 5% of the total outer surface area of the top portion 130. The apparatus, methods, and articles of manufacture described herein are not limited in this regard.

FIG. 5 depicts a top view of the example golf club head 100 of FIG. 1 with a golf ball 550 proximate to the face portion 275. The golf ball 550 may be in contact with and aligned with a geometric center 276 of the face portion 275. The golf ball 550 may have a diameter of about 1.68 inches. A central vertical plane 593 bisects the golf ball 550 and the golf club head 100. A toe-side bounding plane 591 bounds a toe-side of the golf club head 100. A heel-side bounding plane 595 bounds a heel-side of the golf club head 100. A toe-side dividing plane 592 divides the toe-side of the golf club head and bounds a toe-side of the golf ball 550. A heel-side dividing plane 594 divides the heel-side of the golf club head and bounds a heel-side of the golf ball 550. The top portion 130 may include a perimeter that includes a toe-side perimeter, heel-side perimeter, front perimeter, and rear perimeter. The apparatus, methods, and articles of manufacture described herein are not limited in this regard.

The top portion 130 of the golf club head 100 may include a plurality of integral ribs. The integral ribs may form the top stiffening portion 136. The integral ribs (e.g., generally shown as 537, 538, and 539) may provide embedded structural supports within the top portion 130. Each integral rib may be located in a top stiffening region adjacent to one or more thin portions. The top portion 130 may have contoured transition regions (e.g., generally shown as 501 and 502) between the thin portions and the thicker top stiffening portions where the integral ribs reside. Contoured transition regions may prevent or mitigate unwanted stress concentrations within the top portion 130 by avoiding distinct edges between thin portions and adjacent thicker portions (e.g., such as 137, 138, or 139). Stress concentrations may be undesirable as they may result in cracking or delaminating of layers of the top portion 130 during use of the golf club head 100. For example, in an alternative embodiment having non-integral ribs attached to either an inner or outer surface of the top portion 130, a distinct edge may exist at a junction formed between a non-integral rib and a surface of the top portion 130, and that edge may introduce an unwanted stress concentration. After numerous ball strikes, presence of the stress concentration may result in cracking of the top portion 130 proximate to the non-integral rib. This physical deterioration of the top portion 130 may negatively impact performance of the golf club head 100. For instance, as the top portion 130 physically deteriorates, shot-to-shot variability may increase. Shot-to-shot variability may be unacceptable to an individual who requires consistent performance from the golf club head 100. Physical deterioration of the top portion 130 may also negatively affect appearance of the golf club head 100. For the sake of long-term durability, consistency, and appearance, it is therefore desirable to have a top portion 130 with contoured transition regions (501, 502) between the thin portions and the thicker portions containing integral ribs. The apparatus, methods, and articles of manufacture described herein are not limited in this regard.

The top portion 130 may include a toe-side integral rib 538. The toe-side integral rib 538 may extend from the front perimeter 1132 of the crown portion 135 to the rear perimeter 1151 of the crown portion. The toe-side integral rib 538 may extend rearward from the forward portion 131. The toe-side integral rib 538 may extend rearward from a starting location between the central vertical plane 593 and the toe-side dividing plane 592 and terminate at an ending location between the toe-side bounding plane 591 and the toe-side dividing plane 592. The apparatus, methods, and articles of manufacture described herein are not limited in this regard.

In one example, the toe-side integral rib 538 may have a maximum thickness between and including 1.0 mm and 2.0 mm. In another example, the toe-side integral rib 538 may have a maximum thickness greater than or equal to 1.0 mm. In another example, the toe-side integral rib 538 may have a maximum thickness greater than or equal to 2.0 mm. In another example, the toe-side integral rib 538 may have a maximum thickness greater than or equal to 2.1 mm. In yet another example, the toe-side integral rib 538 may have a maximum thickness greater than or equal to 2.2 mm. In yet another example, the toe-side integral rib 538 may have a maximum thickness greater than or equal to 2.4 mm. While the above examples may describe particular thicknesses, the apparatus, methods, and article of manufacture described herein may include the toe-side integral rib 538 with a maximum thickness of less than 2 mm. The apparatus, methods, and articles of manufacture described herein are not limited in this regard.

The top portion 130 may include a heel-side integral rib 539. The heel-side integral rib 539 may extend from a front perimeter 1132 of the crown portion 135 to a rear perimeter 1151 of the crown portion. The heel-side integral rib 539 may extend rearward from the forward portion 131. The heel-side integral rib 539 may extend rearward from a starting location between the central vertical plane 593 and the heel-side dividing plane 594 and terminate at an ending location between the heel-side bounding plane 595 and the heel-side dividing plane 594. The apparatus, methods, and articles of manufacture described herein are not limited in this regard.

In one example, the heel-side integral rib 539 may have a maximum thickness between and including 1.0 mm and 2.0 mm. In another example, the heel-side integral rib 539 may have a maximum thickness greater than or equal to 1.0 mm. In another example, the heel-side integral rib 539 may have a maximum thickness greater than or equal to 2.0 mm. In another example, the heel-side integral rib 539 may have a maximum thickness greater than or equal to 2.1 mm. In yet another example, the heel-side integral rib 539 may have a maximum thickness greater than or equal to 2.4 mm. While the above examples may describe particular thicknesses, the apparatus, methods, and article of manufacture described herein may include the heel-side integral rib 539 with a maximum thickness of less than 2 mm. The apparatus, methods, and articles of manufacture described herein are not limited in this regard.

The top portion 130 may include a central integral rib 537. The central integral rib 537 may extend along the front perimeter 1132 of the crown portion 135. The central integral rib 537 may extend from the toe-side integral rib 538 to the heel-side integral rib 539. The central integral rib 537 may extend from a forward-most end of the toe-side integral rib 538 to a forward-most end of the heel-side integral rib 539. The central integral rib 537 may extend a distance of at least 3 centimeters beside the junction 132 formed between the front perimeter 1132 of the crown portion 135 and the forward portion 131 of the top portion 130. The central integral rib 537 may be located between the toe-side dividing plane 592 and the heel-side dividing plane 594. The central integral rib 537 and the face portion 275 may have parallel curves. In one example, the central integral rib 537 may have a maximum thickness greater than or equal to 2.0 mm. In another example, the central integral rib 537 may have a maximum thickness greater than or equal to 2.1 mm. In yet another example, the central integral rib 537 may have a maximum thickness greater than or equal to 2.4 mm. While the above examples may describe particular thicknesses, the apparatus, methods, and article of manufacture described herein may include the central integral rib 537 with a maximum thickness of less than 2 mm. The apparatus, methods, and articles of manufacture described herein are not limited in this regard.

The integral ribs (e.g., generally shown as 537, 538, and 539) may enhance the flexural strength of the top portion 130. The integral ribs may enhance the compressive strength of the top portion 130. The integral ribs may reduce outward deflection (e.g., bulging) of the top portion 130 in response to an impact force transferred from the body portion 110 to the crown portion 135 during impact with a golf ball. The integral ribs may reduce deflection of the crown portion 135 inward toward in the interior cavity of the golf club head 100 in response to a downward force applied to an outer surface of the crown portion 135. Inward deflection of the crown portion 135 may be easier to accurately measure in a test environment than outward deflection. In certain instances, resistance to inward deflection may correlate to resistance to outward deflection. Inward deflection may be measured by applying a downward force to an outer surface of the crown portion and measuring physical deflection of the crown portion with a suitable measuring device. In one example, when a downward force of 200 pound-force (lbf) is applied to the central top portion 101, the central top portion 101 may deflect less than 0.025 inch. In another example, when a downward force of 200 lbf is applied to the central top portion 101, the central top portion 101 may deflect less than 0.015 inch. In another example, when a downward force of 200 lbf is applied to the central top portion 101, the central top portion 101 may deflect less than 0.012 inch. The apparatus, methods, and articles of manufacture described herein are not limited in this regard.

Certain rules or regulations imposed by the USGA or other governing bodies may limit a spring-like effect of certain designs, materials, or constructions of golf club heads. To ensure a club head 100 conforms to certain rules and regulations, it may therefore be desirable to minimize spring-like effects of certain aspects of the club head. For instance, it may be desirable to minimize a spring-like effect of the top portion 130 by reinforcing the crown portion to minimize deflection during use. The integral ribs may allow the top portion 130 to resist deflection better than a similar lightweight crown portion that lacks integral ribs. In one example, the top portion 130 with integral ribs may only deflect inward about 0.012 inch whereas a crown portion without integral ribs may deflect about 0.020 inch in response to applying a downward force of 200 lbf to the respective crown portions. The apparatus, methods, and articles of manufacture described herein are not limited in this regard.

As shown in FIG. 5, the toe-side integral rib 538 and the heel-side integral rib 539 may diverge in a front-to-rear direction along the top portion 130. In another example, the toe-side integral rib 538 and heel-side integral rib 539 may converge in a front-to-rear direction along the top portion 130. In yet another example, a toe-side integral rib 538 and a heel-side integral rib 539 may converge and then diverge in a front-to-rear direction along the top portion 130. In another example, the toe-side integral rib 538 and heel-side integral rib 539 may be substantially parallel in a front-to-rear direction along the top portion 130. The toe-side rib 538 may include one or more curved portions along its length. Similarly, the heel-side rib 539 may include one or more curved portions along its length. The apparatus, methods, and articles of manufacture described herein are not limited in this regard.

An outer surface of the top portion 130 may have an anti-glare finish. An outer surface of the top portion 130 may have a medium or low gloss appearance to reduce the amount of light reflected upward at an individual's eyes when aligning the golf club head 100 with a golf ball and performing a golf shot. A relative gloss value may be determined by projecting a beam of light at a fixed intensity and angle onto the outer surface of the top portion 130 and measuring the amount of light reflected at an equal but opposite angle upward at the individual. On a measurement scale, a specular reflectance of 0 gloss units (GU) may be associated with a perfectly matte surface, and a specular reflectance of 100 GU may be associated with a highly polished black glass material. Providing a top portion 130 with a relatively low specular reflectance may be desirable to reduce distraction perceived by the individual of the golf club head 100, which may reduce mishits and thereby improve performance. In one example, an outer surface of the top portion 130 may have a specular reflectance of less than 55 GU. In another example, the outer surface of the top portion 130 may have a specular reflectance of less than 40 GU. In yet another example, the outer surface of the top portion 130 may have a specular reflectance of less than 25 GU. In still another example, the outer surface of the top portion 130 may have a specular reflectance of less than 10 GU. While the above examples may describe particular specular reflectance, the apparatus, methods, and article of manufacture may include the outer surface of the top portion 130 with a specular reflectance greater than or equal to 55 GU. The apparatus, methods, and articles of manufacture described herein are not limited in this regard.

In some examples, the outer surface of the top portion 130 may include an antireflective coating 133. In one example, the antireflective coating 133 may have a specular reflectance of less than 55 GU. In another example, the antireflective coating 133 may have a specular reflectance of less than 40 GU. In yet another example, the antireflective coating 133 may have a specular reflectance of less than 25 GU. In still another example, the antireflective coating 133 may have a specular reflectance of less than 10 GU. The apparatus, methods, and articles of manufacture described herein are not limited in this regard.

Figure 6:
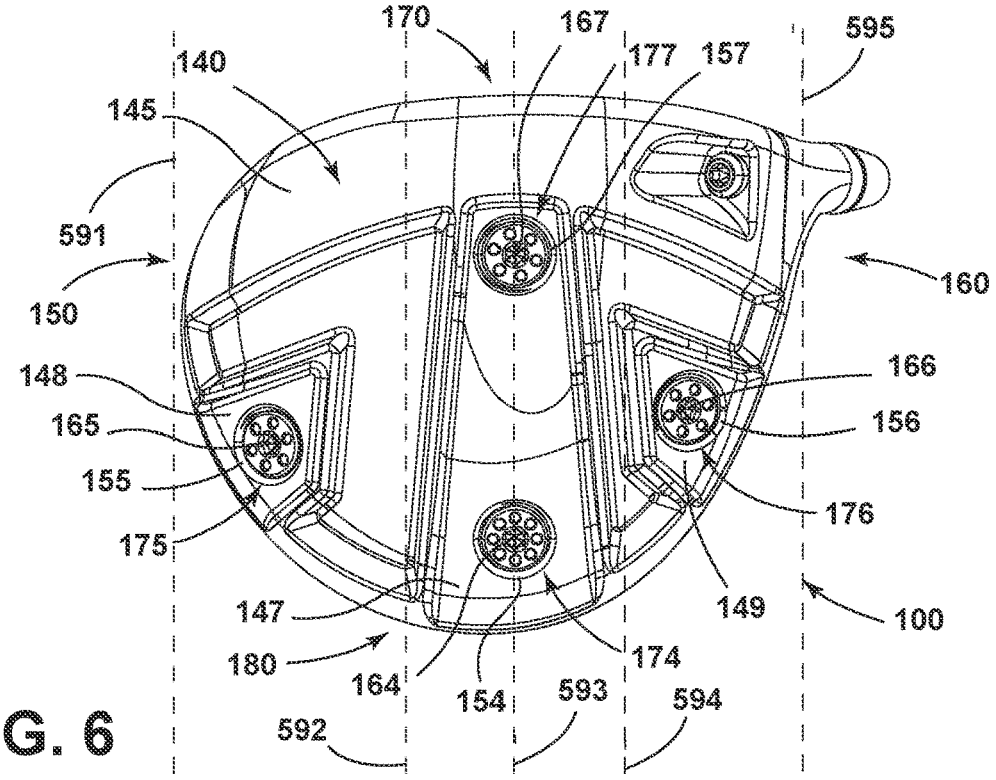
FIG. 6 is a bottom view of the golf club head of FIG. 1.

The golf club head 100 may include a plurality of weigh port regions. Each weight port region may include a weight port. Each weight port may include a weight. As shown in FIG. 6, a first weight port region 174 may be located closer to the rear portion 180 than the front portion 170. A second weight port region 175 may be located closer to the toe portion 150 than the heel portion 160. A third weight port region 176 may be located closer to the heel portion 160 than the toe portion 150. A fourth weight port region 177 may be located closer to the front portion 170 than the rear portion 180. The apparatus, methods, and articles of manufacture described herein are not limited in this regard.

The first weight port region 174 may include a first weight port 154 containing a first weight portion 164. The second weight port region 175 may include a second weight port 155 containing a second weight portion 165. The third weight port region 176 may include a third weight port 156 containing a third weight portion 166. The fourth weight port region 177 may include a fourth weight port 157 containing a fourth weight portion 167. The apparatus, methods, and articles of manufacture described herein are not limited in this regard.

The set of weight portions (e.g., generally shown as weight portions 164, 165, 166, and 167) may have similar or different masses. By using weight portions having similar or different masses in each of the weight ports, the overall mass in a weight port region and/or the mass distribution in the weight port regions may be adjusted to generally optimize and/or adjust the swing weight, center of gravity, moment of inertia, and/or an overall feel of the golf club head 100 for an individual using the golf club head 100. In one example, the set of weight portions may collectively have a mass of at least 8 grams. In another example, the set of weight portions may collectively have a mass of at least 12 grams. In yet another example, the set of weight portions may collectively have a mass of between and including 8 grams and 13 grams. In still yet another example, the set of weight portions may collectively have a mass of between and including 12 grams and 16 grams. In still yet another example, the set of weight portions may collectively have a mass of between and including 15 grams and 19 grams. In still yet another example, the set of weight portions may collectively have a mass of between and including 18 grams and 22 grams. While the above examples may describe particular masses, the apparatus, methods, and articles of manufacture described herein may include the set of weight portions to have an aggregate mass of less than 8 grams or an aggregate mass of greater than 19 grams. The apparatus, methods, and articles of manufacture described herein are not limited in this regard.

The bottom portion 140 of the golf club head 100 may have in inner surface 142 and an outer surface 145. The golf club head 100 may include one or more raised portions protruding outward from the outer surface 145. Each raised portion may include a weight port region. Each weight port region may include a weight port. Each weight port may include a weight portion. The apparatus, methods, and articles of manufacture described herein are not limited in this regard.

Figure 2:
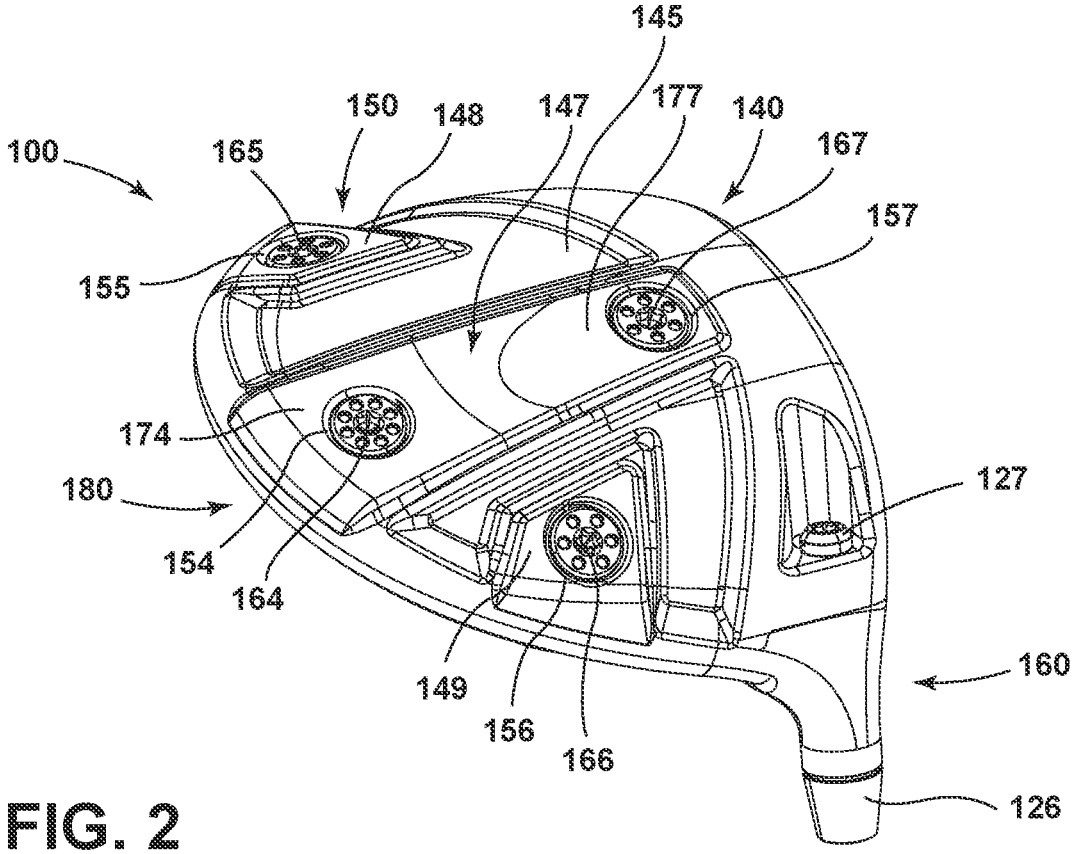
FIG. 2 is a bottom perspective view of the golf club head of FIG. 1.
Figure 3:
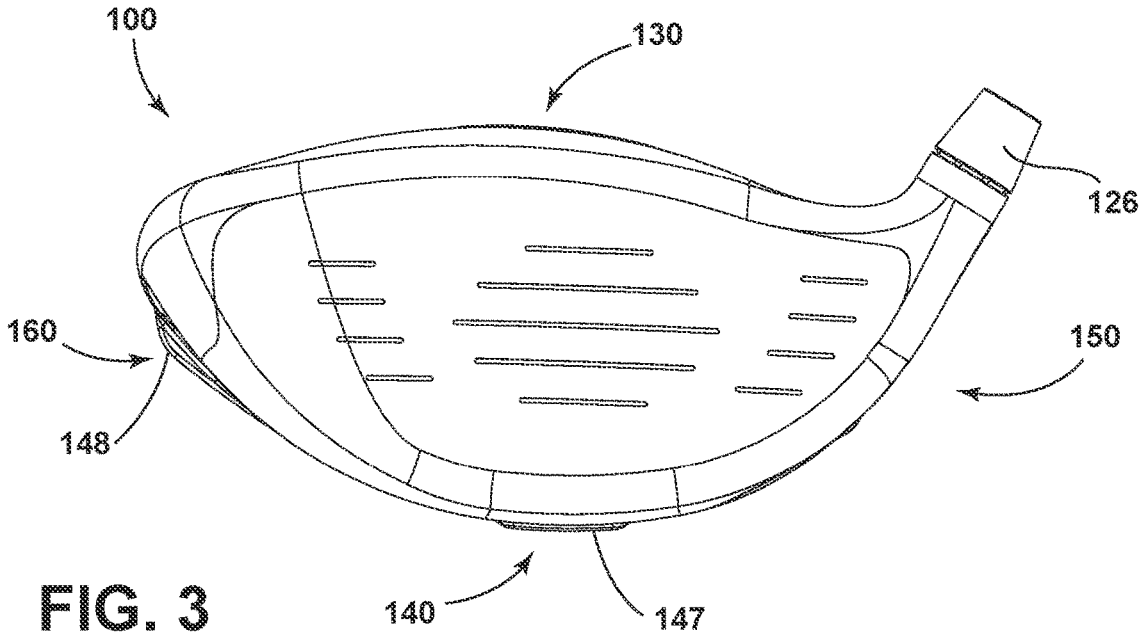
FIG. 3 is a front view of the golf club head of FIG. 1.
Figure 4:
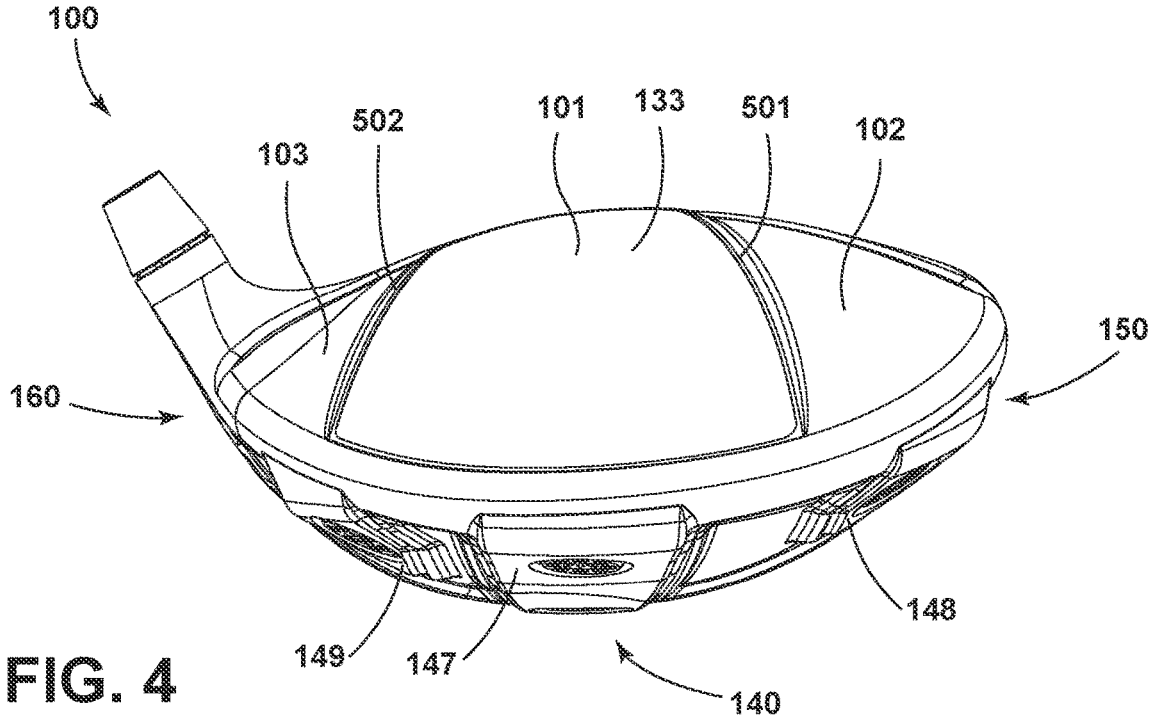
FIG. 4 is a rear view of the golf club head of FIG. 1.

The golf club head 100 may include a central protrusion 147 extending from the outer surface 145 of the bottom portion 140. The central protrusion 147 may extend from the rear portion 180 toward the front portion 170, as shown in FIG. 2. The central vertical plane 593 may pass through the central protrusion 147. The central vertical plane 593 may bisect the central protrusion 147. The central protrusion 147 may be located between the toe-side dividing plane 592 and the heel-side dividing plane 594, as shown in FIG. 6. The central protrusion 147 may include the first weight port region 174. The central vertical plane 593 may pass through the first weight port 154 and the first weight portion 164. The central vertical plane 593 may bisect the first weight port 154 and the first weight portion 164. The central protrusion 147 may include the fourth weight port region 177. The central vertical plane 593 may pass through the fourth weight port 157 and the fourth weight portion 167. The central vertical plane 593 may bisect the fourth weight port 157 and the fourth weight portion 167. The central protrusion 147 may allow placement of weight portions (e.g. 164, 167) a greater distance from a center point of the golf club head 100 to increase perimeter weighting and MOI without increasing club head volume. The apparatus, methods, and articles of manufacture described herein are not limited in this regard.

The golf club head 100 may include a toe-side protrusion 148 extending from the outer surface 145 of the bottom portion 140. The toe-side protrusion 148 may be located between the toe-side dividing plane 592 and the toe-side bounding plane 591. The toe-side protrusion 148 may be located closer to the rear portion 180 than the front portion 170. The toe-side protrusion 148 may include the second weight port region 175. The toe-side protrusion 148 may allow placement of the weight portion 165 a greater distance from the center point of the golf club head 100 to increase perimeter weighting and MOI without increasing club head volume. The apparatus, methods, and articles of manufacture described herein are not limited in this regard.

The golf club head 100 may include a heel-side protrusion 149 extending from the outer surface 145 of the bottom portion 140. The heel-side protrusion 149 may be located between the heel-side dividing plane 594 and the heel-side bounding plane 595. The heel-side protrusion 149 may be located closer to the rear portion 180 than the front portion 170. The heel-side protrusion 149 may include the third weight port region 176. The heel-side protrusion 149 may allow placement of the weight portion 166 a greater distance from the center point of the golf club head 100 to increase perimeter weighting and MOI without increasing club head volume. The apparatus, methods, and articles of manufacture described herein are not limited in this regard.

The golf club head 100 may include an insert 1350. The insert 1350 may be a vibration-dampening insert. The insert 1350 may be a sound-enhancing insert that attenuates certain frequencies. The insert 1350 may include a filler material. As shown in FIG. 9, the insert 1350 may be located on the inner surface 142 of the bottom portion 140 of the golf club head 100. The insert 1350 may be adjacent to one or more of the weight port regions. The insert 1350 may surround one or more of the weight ports. The insert 1350 may abut one or more of the weight port regions. The insert 1350 may abut the third weight port region 176. The insert 1350 may be closer to the heel portion 160 than the toe portion 150. The apparatus, methods, and articles of manufacture described herein are not limited in this regard.

Figure 10:
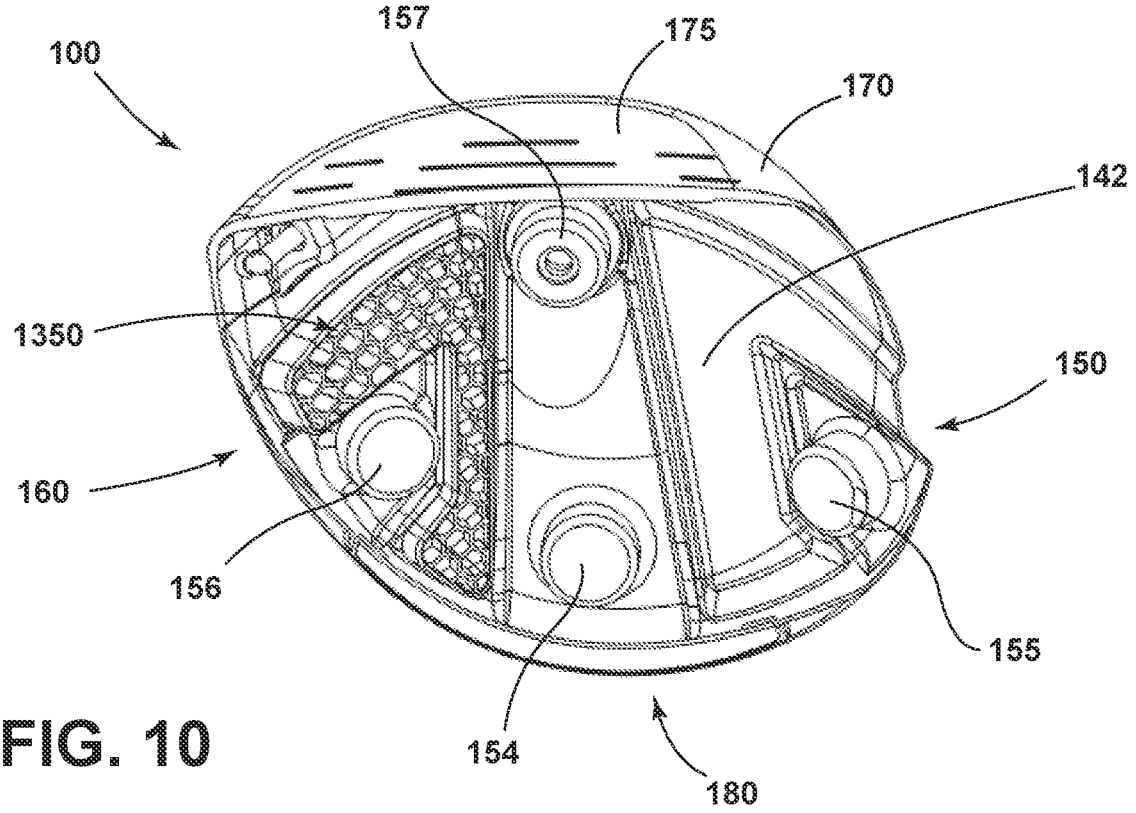
FIG. 10 is a cross-sectional view of the golf club head of FIG. 1 taken along section 10-10 of FIG. 8.
Figure 11:
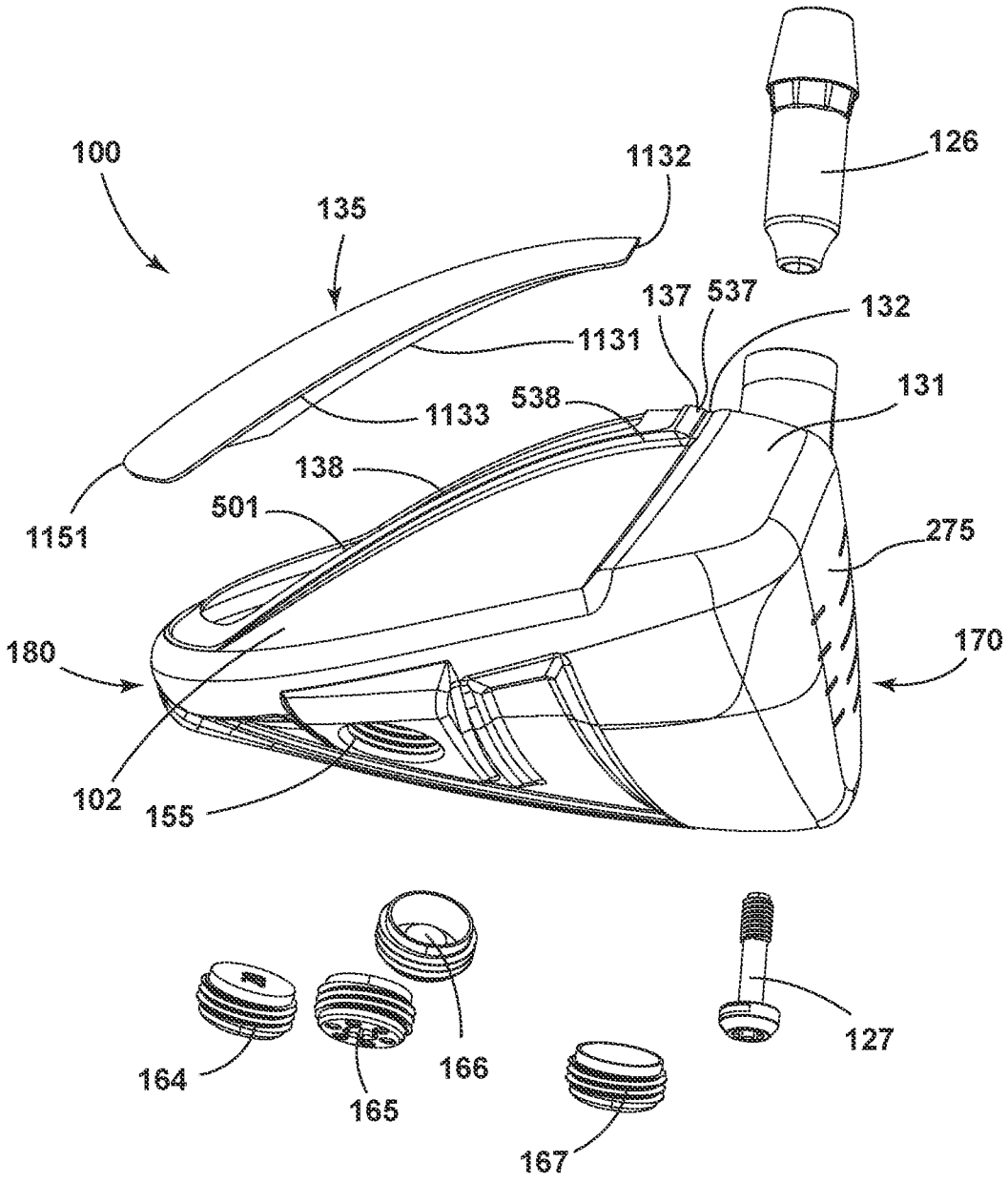
FIG. 11 is an exploded toe side view of the golf club head of FIG. 1.

The insert 1350 may be located between the central vertical plane 593 and the heel-side bounding plane 595. The insert 1350 may be located between the heel-side dividing plane 594 and the heel-side bounding plane 595. The insert 1350 may be located between the central protrusion 147 and the heel-side bounding plane 595. The insert 1350 may be located between the heel-side integral rib 539 and the inner surface 142 of the bottom portion 140. The insert 1350 may extend from a front side of the third weight port 156 to a rear side of the third weight port, as shown in FIG. 10. The insert 1350 may surround or partially surround the third weight port 156. The insert 1350 may include a plurality of hexagonal recesses. The hexagonal recesses may define a honeycomb pattern. The apparatus, methods, and articles of manufacture described herein are not limited in this regard.

The filler material may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont' HPF family of ethylene copolymers are injection moldable and may be used with conventional injection molding equipment and molds, provide low compression, and provide high resilience. The apparatus, methods, and articles of manufacture described herein are not limited in this regard.

Any of the golf club heads described herein may be part of a golf club. The golf club may include a shaft (not shown) extending from the golf club head. The shaft may have a first end attached to a hosel of the golf club head and a second end opposite the first end. The golf club may include a grip at or proximate to the second end of the shaft. The shaft may be formed from metal material, composite material, or any other suitable material or combination of materials. The grip may be formed from rubber material, polymer material, or any other suitable material or combination of materials. The apparatus, methods, and articles of manufacture described herein are not limited in this regard.

The apparatus, methods, and articles of manufacture described herein may include one or more club identifiers (e.g., a serial number, a matrix barcode, a brand name, a model, a club number, a loft angle, a character, etc.). For example, the golf club head may include a visual indicator such as a club number to identify the type of golf club. In one example, the club number may correspond to the loft angle of the golf club head (e.g., 3, 4, 5, 6, 7, 8, or 9). In one example, a 7-iron type golf club head may be marked with "7". In another example, the golf club head may include the loft angle. For example, a 54-degree wedge type golf club head may be marked "54." In yet another example, a 10.5-degree driver type golf club head may be marked "10.5." The club identifier may be a trademark to identify a brand or a model of the golf club head. The club identifier may be another type of visual indicator such as a product number or a serial number to identify the golf club head 100 as authentic equipment, to track inventory, or to distinguish the golf club head from fake or counterfeit products. Alternatively, the club identifier may be a digital signature or a machine-readable optical representation of information or data about the golf club head (e.g., numeric character(s), alphanumeric character(s), byte(s), a one-dimensional barcode such as a Universal Product Code (UPC), a two-dimensional barcode such as a Quick Response (QR) code, etc.). The club identifier may be placed at various locations on the golf club head (e.g., the hosel portion, the face portion, the sole portion, etc.) using various methods (e.g., laser etched, stamped, cast, or molded onto the golf club head). For example, the club identifier may be a serial number laser etched onto the hosel portion of the golf club head. Instead of being an integral part of the golf club head, the club identifier may be a separate component coupled to the golf club head (e.g., a label adhered via an adhesive or an epoxy).

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion comprising a front portion, a rear portion, a toe portion, a heel portion, a bottom portion, and a top portion;

the top portion comprising:

a forward portion extending in a front-to-rear direction;

a toe-side top portion aft of the forward portion;

a heel-side top portion aft of the forward portion;

a raised central top portion aft of the forward portion and located between the toe-side top portion and the heel-side top portion;

an opening through the raised central top portion;

a shoulder portion extending inward toward the opening;

a crown portion attached to the shoulder portion and covering the opening; and a junction separating the forward portion from the toe-side top portion, the heel-side top portion, and the raised central top portion, wherein an outer surface of the heel-side top portion is recessed below the forward portion proximate to the junction, wherein an outer surface of the toe-side top portion is recessed below the forward portion proximate to the junction, and wherein an outer surface of the crown portion is elevated above the outer surface of the toe-side top portion and the outer surface of the heel-side top portion.

2. A golf club head as defined in claim 1, wherein the outer surface of the toe-side top portion is recessed below the forward portion proximate the junction by a distance greater than or equal to 0.5 mm.

3. A golf club head as defined in claim 1, wherein the outer surface of the heel-side top portion is recessed below the forward portion proximate the junction by a distance greater than or equal to 0.5 mm.

4. A golf club head as defined in claim 1, wherein the shoulder portion extends a distance of greater than or equal to 2 mm and less than or equal to 8 mm inward toward the opening.

5. A golf club head as defined in claim 1, wherein an outer surface area of the raised central top portion is greater than or equal to 30% of a total outer surface area of the top portion.

6. A golf club head as defined in claim 1, wherein an outer surface area of the toe-side top portion is greater than or equal to 15% of a total outer surface area of the top portion.

7. A golf club head as defined in claim 1, wherein an outer surface area of the heel-side top portion is greater than or equal to 5% of a total outer surface area of the top portion.

8. A golf club head comprising:

a body portion comprising a front portion, a rear portion, a toe portion, a heel portion, a bottom portion, and a top portion;

the top portion comprising:

a forward portion extending in a front-to-rear direction of the golf club head;

a toe-side top portion aft of the forward portion;
a heel-side top portion aft of the forward portion;
a raised central top portion aft of the forward portion and located between the toe-side top portion and the heel-side top portion;
a top stiffening portion comprising:
a first top stiffening portion adjacent the forward portion and extending in a toe-to-heel direction;
a second top stiffening portion extending from a toe-side end of the first top stiffening portion toward the rear portion, the second top stiffening portion disposed between the toe-side top portion and the raised central top portion; and
a third top stiffening portion extending from a heel-side end of the first top stiffening portion toward the rear portion, the third top stiffening portion disposed between the heel-side top portion and the raised central top portion;
an opening through the raised central top portion;
a shoulder portion extending inward toward the opening; and
a crown portion attached to the shoulder portion and covering the opening,
wherein the second top stiffening portion and the third top stiffening portion diverge in the front-to-rear direction of the golf club head, and
wherein the crown portion widens in a rearward direction.

9. A golf club head as defined in claim 8, wherein the raised central top portion deflects less than 0.025 inch when a downward force of 200 pound-force (lbf) is applied to the raised central top portion.

10. A golf club head as defined in claim 8, wherein the second top stiffening portion tapers in width in the front-to-rear direction of the golf club head.

11. A golf club head as defined in claim 8, wherein the third top stiffening portion tapers in width in the front-to-rear direction of the golf club head.

12. A golf club head as defined in claim 8, wherein the second top stiffening portion has a thickness greater than an average thickness of the crown portion.

13. A golf club head as defined in claim 8, wherein the third top stiffening portion has a thickness greater than an average thickness of the crown portion.

14. A golf club head comprising:
a body portion comprising a front portion, a rear portion, a toe portion, a heel portion, a bottom portion, and a top portion;
the top portion comprising:
a forward portion extending in a front-to-rear direction of the golf club head;
a toe-side top portion aft of the forward portion;
a heel-side top portion aft of the forward portion;
a raised central top portion aft of the forward portion and located between the toe-side top portion and the heel-side top portion;
an opening through the raised central top portion;
a shoulder portion extending inward toward the opening;
a crown portion attached to the shoulder portion and covering the opening;
a toe-side integral rib aft of the forward portion, the toe-side integral rib extending in the front-to-rear direction of the golf club head and disposed between the toe-side top portion and the raised central top portion; and
a heel-side integral rib aft of the forward portion, the heel-side integral rib extending in the front-to-rear direction of the golf club head and disposed between the heel-side top portion and the raised central top portion,
wherein the toe-side integral rib is thicker than at least one of the toe-side top portion and the raised central top portion, and
wherein the heel-side integral rib is thicker than at least one of the heel-side top portion and the raised central top portion.

15. A golf club head as defined in claim 14, the top portion further comprising a central integral rib adjacent the forward portion and extending a distance of at least 3 centimeters between the toe-side integral rib and the heel-side integral rib.

16. A golf club head as defined in claim 15, wherein the central integral rib has a maximum thickness greater than or equal to 2.0 mm.

17. A golf club head as defined in claim 14, wherein the toe-side integral rib has a maximum thickness greater than or equal to 1.0 mm and less than or equal to 2.0 mm.

18. A golf club head as defined in claim 14, wherein the heel-side integral rib has a maximum thickness greater than or equal to 1.0 mm and less than or equal to 2.0 mm.

19. A golf club head as defined in claim 14, wherein the raised central top portion has a quadrilateral shape.

20. A golf club head as defined in claim 14, wherein the opening and the crown portion widen in a rearward direction.

* * * * *